US012455135B2

(12) United States Patent
Maffett et al.

(10) Patent No.: US 12,455,135 B2
(45) **Date of Patent: *Oct. 28, 2025**

(54) QUICK TAKE-DOWN FIREARM

(71) Applicant: LEO TakeDown, LLC, Rome, GA (US)

(72) Inventors: Michael Lance Maffett, Rome, GA (US); Shannon Howard McCall, Laceys Spring, AL (US)

(73) Assignee: LEO TAKEDOWN, LLC, Rome, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/090,166

(22) Filed: Mar. 25, 2025

(65) Prior Publication Data

US 2025/0224192 A1 Jul. 10, 2025

Related U.S. Application Data

(63) Continuation of application No. 17/061,119, filed on Oct. 1, 2020, which is a continuation of application No. 16/243,304, filed on Jan. 9, 2019, now Pat. No. 10,830,551, which is a continuation-in-part of application No. 15/657,958, filed on Jul. 24, 2017, now Pat. No. 10,222,157, which is a continuation-in-part of application No. 15/357,538, filed on Nov. 21, 2016, now Pat. No. 9,879,935.

(Continued)

(51) Int. Cl.

| | |
|---|---|
| ***F41A 21/48*** | (2006.01) |
| ***F41A 11/00*** | (2006.01) |
| *F41C 23/16* | (2006.01) |

(52) U.S. Cl.

CPC ..... *F41A 21/484* (2013.01); *F41A 11/00* (2013.01); *F41A 21/482* (2013.01); *F41C 23/16* (2013.01)

(58) Field of Classification Search

CPC ..... F41A 21/00; F41A 21/48; F41A 21/481; F41A 21/482; F41A 21/484; F41A 21/485; F41A 21/488

USPC ..... 89/125, 191.01, 191.02, 192, 193, 194; 42/75.01, 75.02, 75.1

See application file for complete search history.

(56) References Cited

U.S. PATENT DOCUMENTS

| | | | | |
|---|---|---|---|---|
| 2,625,766 A | | 1/1953 | Simpson | |
| 2,732,769 A | * | 1/1956 | Simpson | F41A 21/487 89/193 |

(Continued)

OTHER PUBLICATIONS

New DOLOS System from Huntertown Arms, The Firearm Blog, https://www.thefirearmblog.com/blog/2016/03/31/new-dolos-system-from-huntertown-arms/, Posted Mar. 31, 2016, (Admitted Prior Art), 7 pages.

*Primary Examiner* — Bret Hayes
(74) *Attorney, Agent, or Firm* — Bennet K. Langlotz; Langlotz Patent & Trademark Works, LLC

(57) ABSTRACT

Quick take-down firearms and methods of using quick-take down firearms. The quick-take down includes an upper receiver coupling and a barrel coupling. The quick take-down can be unlocked by sliding a sliding lock collar in a translational motion to an unlocked position to release locking elements from a locked configuration. In the unlocked position, a barrel and handguard may be installed onto and removed from the upper receiver of the firearm. Releasing the sliding lock collar returns it to a locked position, securing the barrel and handguard to the upper receiver.

18 Claims, 30 Drawing Sheets

Related U.S. Application Data

(60) Provisional application No. 62/433,696, filed on Dec. 13, 2016, provisional application No. 62/314,758, filed on Mar. 29, 2016.

(56) References Cited

U.S. PATENT DOCUMENTS 3,181,262 A 5/1965 Bridge, Sr.
3,667,343 A 6/1972 Jurkowski
4,546,584 A 10/1985 A'Costa
4,920,679 A 5/1990 Sarles
5,433,133 A 7/1995 La France
5,509,345 A 4/1996 Cyktich
5,559,302 A 9/1996 Latka
5,685,102 A 11/1997 Latka
5,706,599 A * 1/1998 Knight ..... F41A 21/485 42/51
5,987,797 A 11/1999 Dustin
6,223,458 B1 * 5/2001 Schwinkendorf ..... F41A 21/487 42/1.06
6,273,080 B1 8/2001 Sullivan, Jr.
6,655,372 B1 12/2003 Field et al.
6,959,509 B2 11/2005 Vais
7,076,904 B1 7/2006 Rustick
7,353,740 B1 4/2008 Hoffman
7,574,823 B2 8/2009 Nakayama
7,610,710 B2 11/2009 Brittingham
7,676,975 B2 3/2010 Dueck et al.
7,721,639 B2 5/2010 Wossner
7,946,059 B2 5/2011 Borel
8,291,805 B1 10/2012 Quilligan
8,479,429 B2 7/2013 Barrett et al.
8,490,312 B2 7/2013 Barrett et al.
8,505,227 B2 8/2013 Barrett et al.
8,607,490 B1 12/2013 Zinsner
8,689,478 B2 4/2014 Patel
8,769,853 B1 7/2014 LaRue
8,782,943 B2 7/2014 Jarboo
8,839,545 B1 9/2014 Gangl et al.
8,863,425 B2 10/2014 Lee
8,910,746 B1 12/2014 McKenzie
8,997,621 B1 4/2015 Dater et al.
9,057,576 B2 6/2015 Barrett et al.
9,121,656 B1 9/2015 McKenzie
9,175,919 B2 11/2015 Russell et al.
9,228,786 B2 1/2016 Sullivan et al.
9,234,717 B2 1/2016 Jarboe
9,383,156 B2 7/2016 Steimke et al.
9,448,027 B1 9/2016 Zinsner
9,879,935 B2 1/2018 Maffett
10,066,891 B2 * 9/2018 Iwasawa ..... F41A 21/487
10,222,157 B2 * 3/2019 Maffett ..... F41A 11/00
10,830,551 B2 11/2020 Maffett et al.
2006/0277810 A1 12/2006 Leitner-Wise
2007/0095198 A1 5/2007 Dater
2015/0198403 A1 7/2015 Bentley
2015/0308779 A1 10/2015 McGinty
2015/0369555 A1 * 12/2015 Daniel ..... F41A 21/487 42/75.02
2016/0033225 A1 2/2016 Selvetti
2016/0054096 A1 2/2016 Dzwill
2016/0102935 A1 4/2016 Young
2016/0116251 A1 4/2016 Mather et al.
2016/0209155 A1 7/2016 Dodson
2017/0160037 A1 6/2017 Gray
2017/0268844 A1 * 9/2017 Smith ..... F41A 3/66

* cited by examiner

QUICK TAKE-DOWN FIREARM

CROSS-REFERENCE TO RELATED APPLICATIONS

This patent is a Continuation of U.S. non-provisional patent application Ser. No. 17/061,119 filed Oct. 1, 2020 for a "QUICK TAKE-DOWN FIREARM," which is a Continuation of U.S. non-provisional patent application Ser. No. 16/243,304 filed Jan. 9, 2019 now issued as U.S. Pat. No. 10,830,551 for a "QUICK TAKE-DOWN FIREARM," which is a Continuation-in-Part of U.S. non-provisional patent application Ser. No. 15/657,958 filed Nov. 21, 2016 now issued as U.S. Pat. No. 10,222,157 for a "Quick Take-Down Firearm," which is a Continuation-in-Part of U.S. non-provisional patent application Ser. No. 15/357,538, filed Nov. 21, 2016 now issued as U.S. Pat. No. 9,879,935 for a "Quick Take-Down Firearm," which claims the benefit of U.S. provisional patent application No. 62/314,758, filed Mar. 29, 2016 for a "Straight-in, rifle barrel attachment & detachment using a ball bearing positive lock," the contents of all of which are incorporated in their entireties by this reference.

U.S. non-provisional patent application Ser. No. 15/657,958 filed Nov. 21, 2016 for a "Quick Take-Down Firearm" also claims the benefit of U.S. provisional patent application No. 62/433,696, filed Dec. 13, 2016 for an "Upper receiver and barrel designed with integrated, straight-in, positive lock coupling," the contents of which are incorporated in their entirety by this reference.

FIELD OF THE INVENTION

The present invention relates to firearms, and more particularly to a firearm having a quick take-down coupling that releasably secures a rifle barrel to an upper receiver.

BACKGROUND OF THE INVENTION

AR-15, AR Pistols, M4, M16 and similar prior art MILSPEC rifles cannot be quickly disassembled and reassembled where the rifle barrel connects to the upper receiver, a process which usually requires the use of specialized tools and a work-bench equipped with a vise. While there are some prior art systems that allow for in-field tool-less disassembly and reassembly of the barrel from the upper receiver, these systems are not effective or robust, are complicated to use, and do not allow for use of standard MILSPEC had guards and other accessories commonly used with these types of firearms.

SUMMARY OF THE INVENTION

This patent is for quick-take down firearms and methods of using quick-take down firearms.

In one non-limiting example, the quick-take down includes an upper receiver coupling configured to be secured to an upper receiver threading of the firearm, the upper receiver coupling including several rotationally offset gas tube tunnels extending through the upper receiver coupling; further includes a rifle barrel coupling configured to be secured to a barrel of the firearm; and further includes a sliding lock collar configured to be slid in a translational motion between a locked position and an unlocked position, the sliding lock collar biased to the locked position; when the sliding lock collar is in the unlocked position the barrel of the firearm can be removed from and installed on the upper receiver; when the sliding lock collar is in the locked position and the barrel is installed on the upper receiver the upper receiver coupling is secured to the rifle barrel coupling thereby securing the barrel to the upper receiver.

In one non-limiting example, a method of assembly for a quick take-down firearm includes: sliding a sliding lock collar in a translational motion to an unlocked position to release a plurality of locking elements from a locked configuration, in which the sliding lock collar is biased away from the unlocked position towards a locked position; next, while the sliding lock collar is held at the unlocked position, inserting a barrel of the firearm into an upper receiver of the firearm, in which an upper receiver coupling is secured to threading of the upper receiver, the upper receiver coupling comprising a gas tube tunnel extending through a body of the upper receiver coupling and a barrel coupling is secured to the barrel; next inserting the barrel into the upper receiver further comprises inserting a barrel pin of the barrel into a notch of the upper receiver threading, and inserting a gas tube of the barrel through the gas tube tunnel of the upper receiver coupling; and next, after inserting the barrel into the upper receiver, releasing the sliding lock collar such that it slides in the translational motion to the locked position to secure the upper receiver coupling to the barrel coupling.

BRIEF DESCRIPTION OF THE DRAWINGS

The same reference numerals refer to the same parts throughout the various figures.

DESCRIPTION OF THE CURRENT EMBODIMENT

Figure 1:
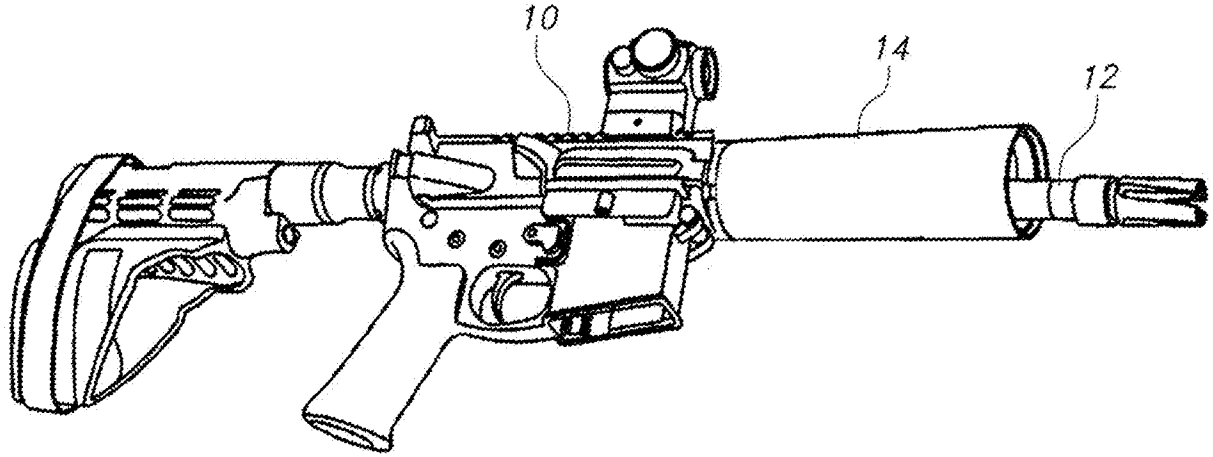
FIG. 1 (PRIOR ART)
FIG. 1 shows an example of a prior art firearm.

An embodiment of the quick detach facility for a firearm of the present invention is shown and generally designated by the reference numeral 500.

Figure 2:
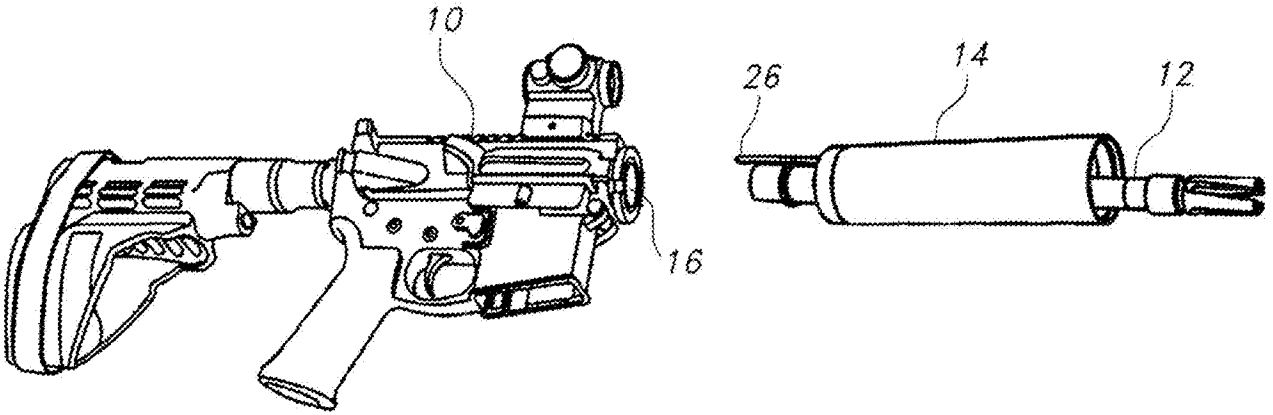
FIG. 2 (PRIOR ART)
FIG. 2 shows the firearm of FIG. 1 with the barrel and handguard disassembled from the upper receiver.

FIGS. 1 and 2 show a prior art firearm, which, in this example, is an AR-15. The quick take-down couplings described in this patent are not limited to use with AR-15's, however, and may be used with a wide variety of firearms where it may be desirable to be able to quickly take down and assemble a firearm. As non-limiting examples, the quick take-down couplings of this patent may also be used with M4's, M16's, and similar MILSPEC rifles.

The firearm of FIGS. 1 and 2 includes an upper receiver 10, a barrel 12, and a handguard 14. FIG. 1 shows the firearm assembled with the barrel 12 and handguard 14 attached to the upper receiver 10. FIG. 2 shows the firearm disassembled with the barrel 12 and handguard 14 removed as a unit from the upper receiver 10.

Figure 3:
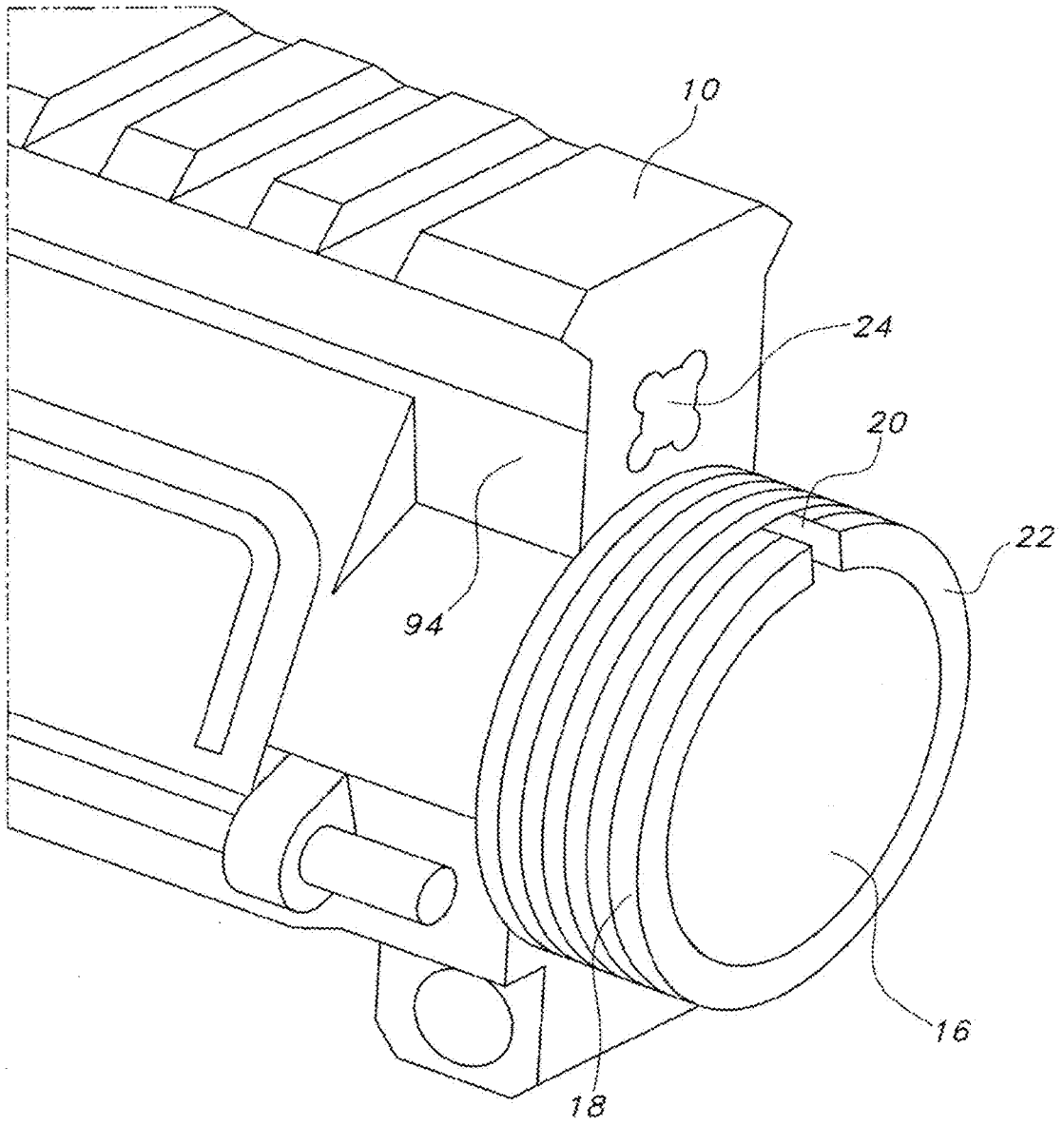
FIG. 3 (PRIOR ART)
FIG. 3 shows the upper receiver of the firearm of FIG. 1 in more detail.

FIG. 3 shows in more detail an example of a prior art upper receiver 10. The upper receiver 10 includes an opening 16 for receiving an end of the barrel 12, threads 18 surrounding the opening 16, a notch 20 in the threads 18, and reference surface 22 (e.g. the shoulder where threading 18 ends). FIG. 3 also shows another opening 24 in the upper receiver 10 for receiving a gas tube or piston that facilitates cycling of the firearm (FIG. 2 shows a gas tube 26).

Figure 4A:
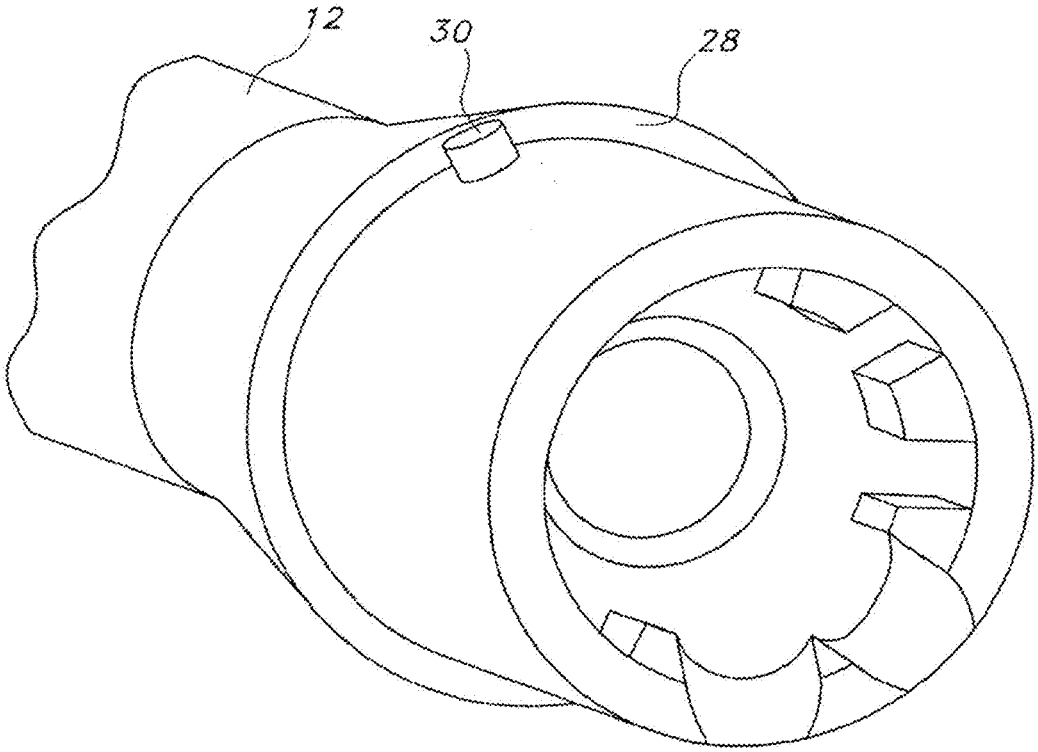
FIG. 4A (PRIOR ART)
FIGS. 4A-4B show and end of the barrel of the firearm of FIG. 1 in more detail.
Figure 4B:
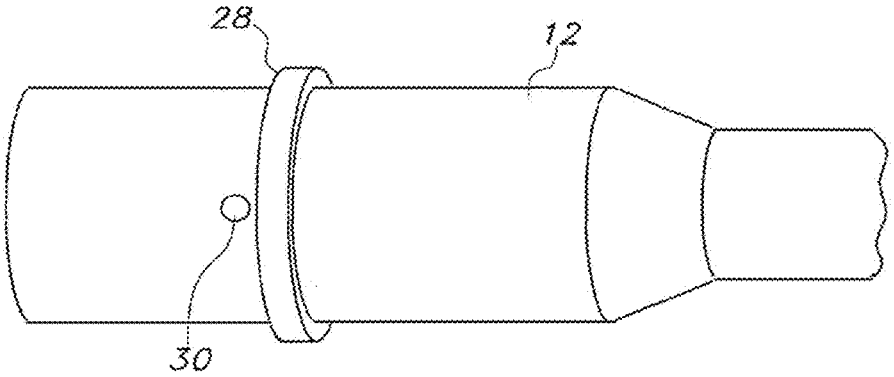
FIG. 4B (PRIOR ART)
Figure 5A:
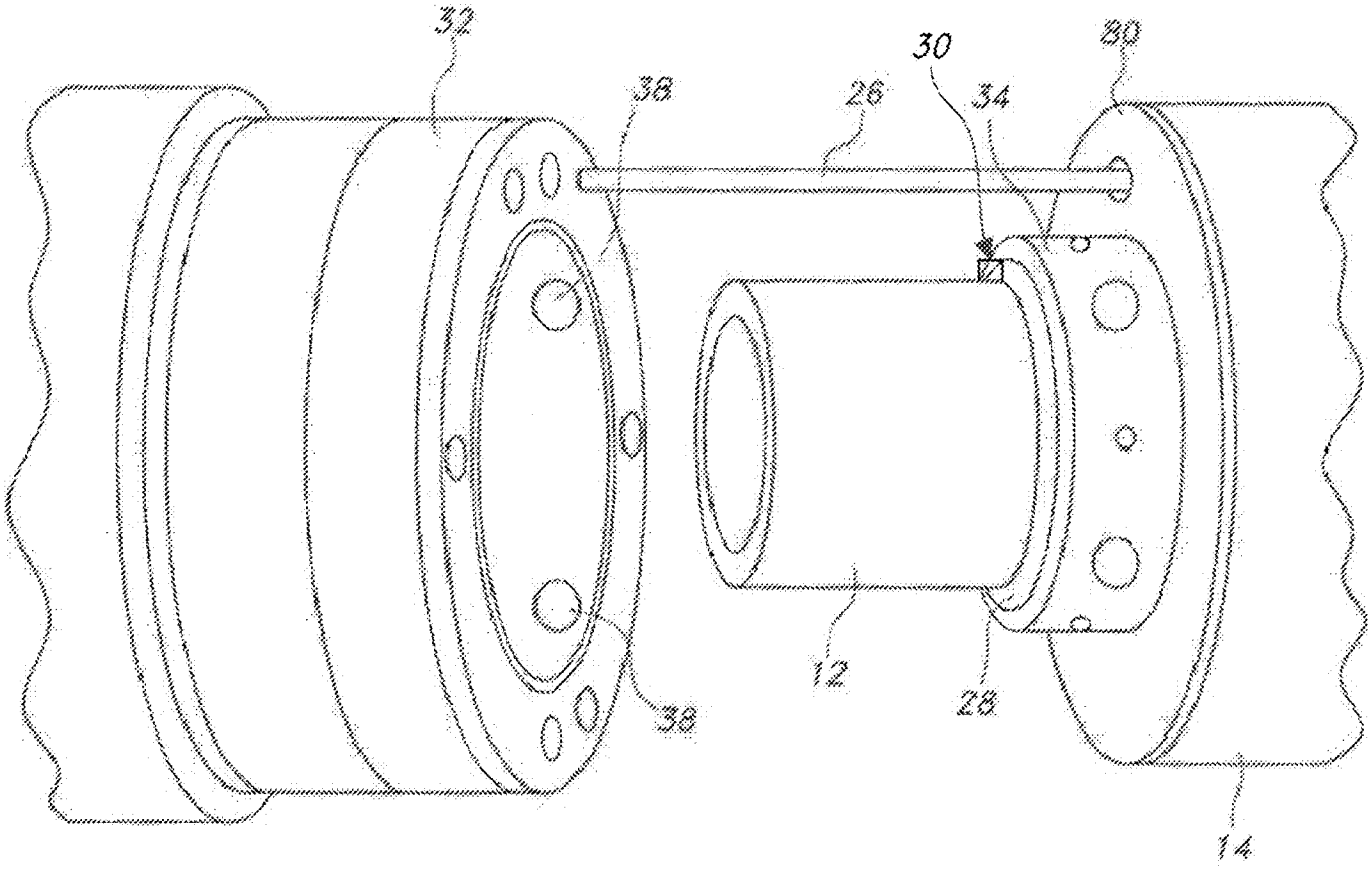
FIG. 5A schematically shows an example of a quick take-down coupling installed on a firearm.
Figure 5B:
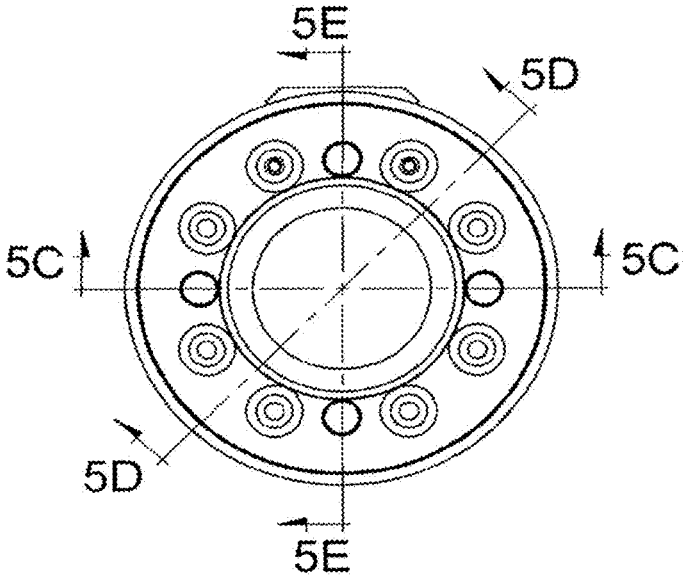
FIGS. 5B-5E show end and cross-sectional views of the quick take-down coupling of Figure SA.
Figure 5E:
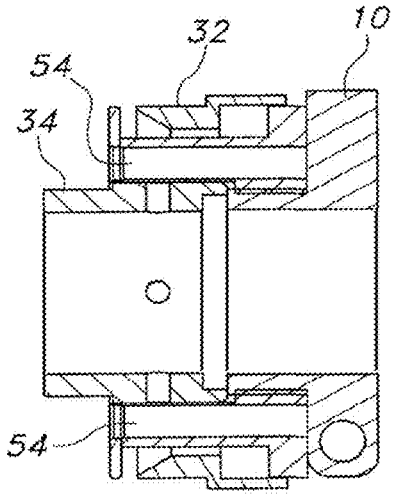
Figure 5C:
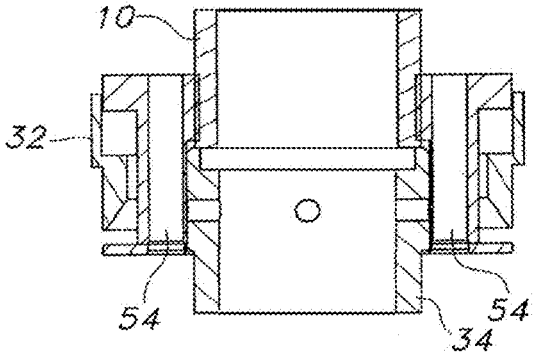
Figure 5D:
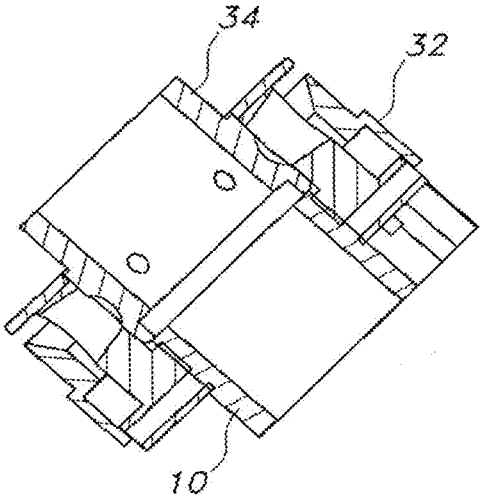

FIGS. 4A and 4B show in more detail an example of a prior art barrel 12. The barrel 12 includes on its outer surface a reference surface 28 (e.g. a ridge extending around the barrel) and a pin 30.

In the prior art, the barrel 12 was attached to the upper receiver 10 by inserting the end of the barrel 12 into the upper receiver's opening 16 until the barrel reference surface 28 contacted the reference surface of the upper receiver 22 and the pin 30 was fully seated in the notch 20. Next, a barrel nut (not shown) would be threaded onto the threads 18 of the upper receiver 10 to secure the barrel 12 in the opening 16. A handguard (e.g. such as handguard 14 shown in FIGS. 1 and 2) could be secured by threading the handguard onto exterior threads of the barrel nut or in other manners.

Quick Take-Down Coupling Example

FIGS. 5A-5E show an example of a quick take-down coupling that can be used with the firearm of FIGS. 1-4 to provide quick and easy installation and removal of the barrel from the upper receiver. The quick take-down coupling of FIGS. 5A-5E includes an upper receiver coupling 32 and a barrel coupling 34. The upper receiver coupling 32 secures to the threads 18 of the upper receiver. The barrel coupling 34 secures to the barrel 12 proximate the reference surface 28 and pin 30. The quick take-down coupling has a locking mechanism, described in further detail below, for locking and unlocking the upper receiver coupling 32 from the barrel coupling 34, providing for quick and easy installation and removal of the barrel 12 from the upper receiver 10. FIGS. 5A-5E provide a general overview of the upper receiver coupling 32 and barrel coupling 34 components, and do not show all of the individual elements of those components.

Figure 6:
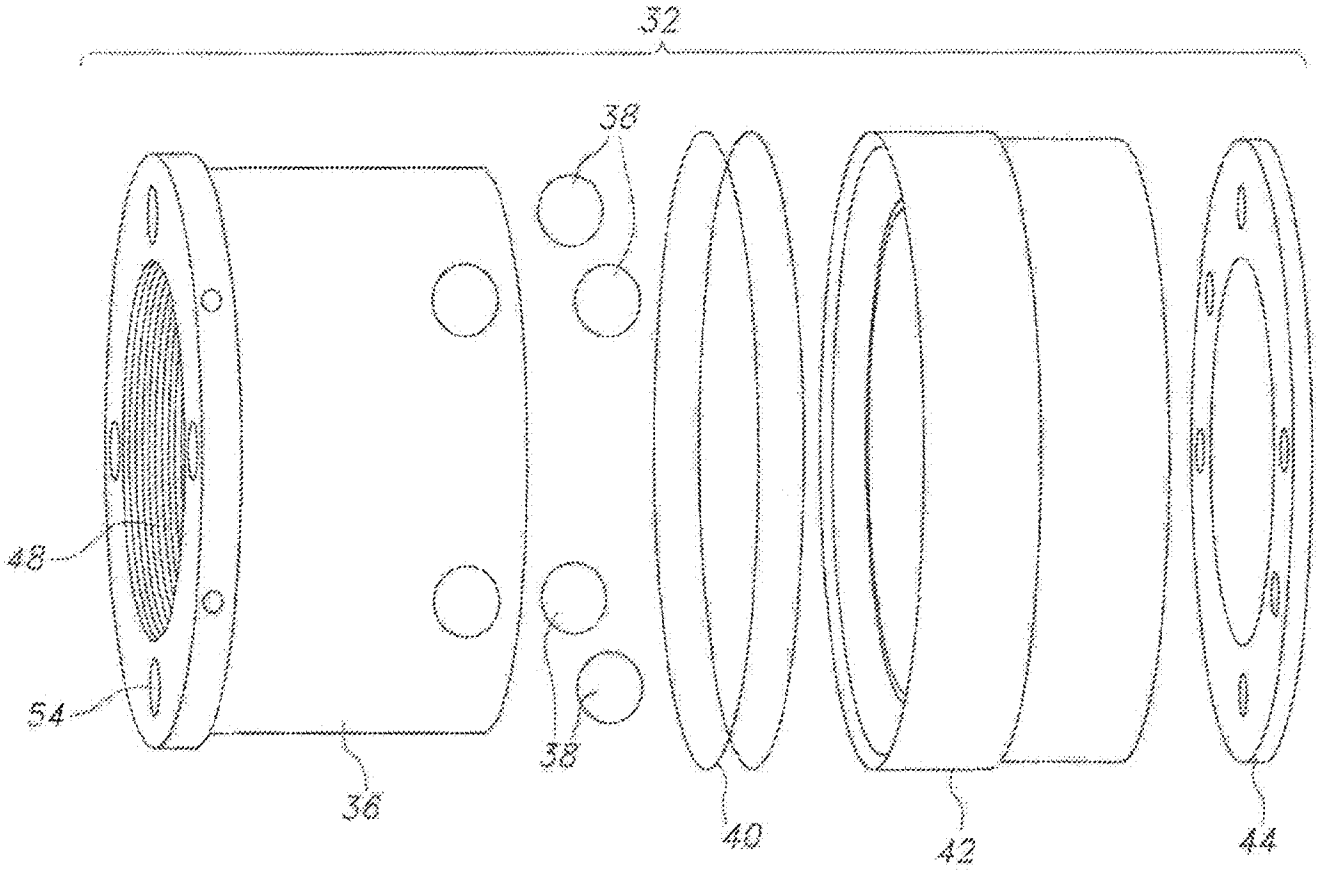
FIG. 6 shows an example of an upper receiver coupling component in a disassembled condition.

FIGS. 6 through 9 show the upper receiver coupling 32 of FIG. 5 in further detail. Referring to FIG. 6, the upper receiver coupling 32 includes, from left to right, a body 36, locking elements 38, resilient element 40, sliding lock collar 42, and face plate 44. The resilient element 40 is shown in FIG. 6 as a coil spring, although other types of resilient elements may be used, such as a wave spring.

FIGS. 7A-7D show the body 36 of FIG. 6 in further detail. The body 36 includes an opening 46 extending through it from one end to the other. At least a portion of the opening 46 includes interior threading 48 (see FIG. 6) which is configured to engage the exterior threading 18 of the upper receiver 10. In other words, the pitch, thread angle, major diameter, minor diameter, etc. of the threading 48 of the body 36 is configured to correspond with the pitch, thread angle, major diameter, minor diameter, etc. of the threading 18 of the upper receiver 10. In some embodiments, the body threading 48 is MILSPEC or other standardized threading allowing it to be installed on a wide variety of commercially available firearms. The body 36 of FIGS. 7A-7D also includes through holes 50 around the perimeter of the body 36 for receiving set screws or similar items to further secure the upper receiver coupling 32 to the upper receiver threads 18. In some embodiments, the set screws used may be nylon or another relatively soft material to lessen the risk of damaging the upper receiver threads 18.

The body 36 of FIGS. 7A-7D further includes apertures 52 spaced around the body 36 configured to receive locking elements 38 (e.g. ball bearings) such that portions of the locking elements may protrude into the opening 46 of the body 36 when the upper receiver coupling 32 is in a locked configuration (discussed further below). As shown in FIG. 7D, the apertures taper so that, in cooperation with the shape of the locking elements 38, the amount of penetration of the locking elements 38 into the opening 46 is limited.

Figure 7A:
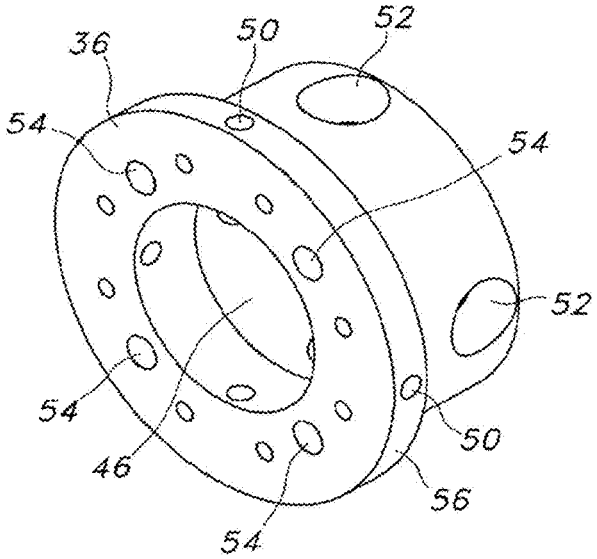
FIGS. 7A-7D show an example of a body of an upper receiver coupling component.
Figure 7B:
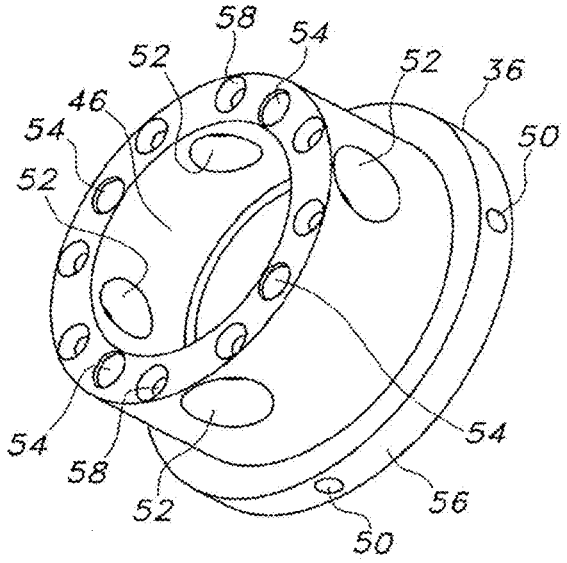
Figure 7C:
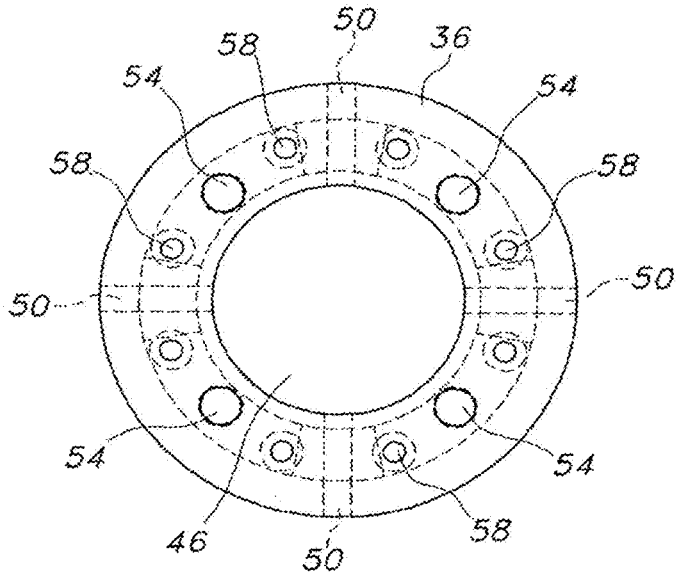
Figure 7D:
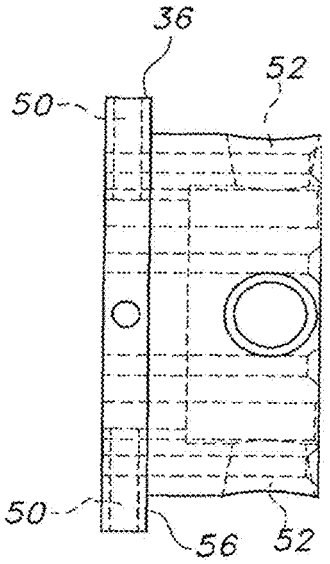

The body 36 of FIGS. 7A-7D further includes several tunnels 54 extending through the length of the body from one end to the other. The tunnels 54 are configured to allow passage of a gas tube or piston associated with the barrel 12 through the body 36 and into the opening 24 on the upper receiver. As shown in FIGS. 7A-7C, the tunnels 54 are rotationally offset from one another (in this example, there are four tunnels 54 spaced apart 90 degrees from adjacent tunnels 54) and also rotationally offset from the apertures 52 in the body 36. In this example, the tunnels 54 are rotationally offset to allow for proper alignment of one of the tunnels 54 with the opening 24 in the upper receiver 10 when the upper receiver coupling 32 is secured to the upper receiver threads 18 at a desired torque or within a desired torque range.

In other embodiments, tunnels are not necessary. For example, in some embodiments, the quick-take down system may be used with an AR Pistol or other firearm that uses direct blowback cycling, without the need for a gas tube or piston.

The body 36 of FIGS. 7A-7D further includes a flange or shoulder 56 and openings 58, the purposes of which will be described further below.

Figure 8A:
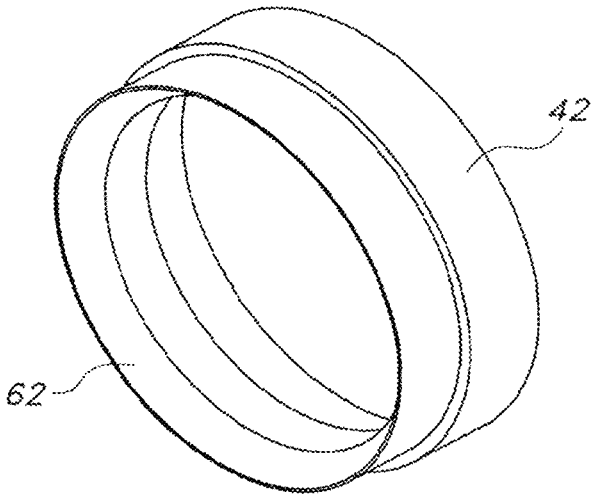
FIGS. 8A-8C show an example of a sliding lock collar of an upper receiver coupling component.
Figure 8B:
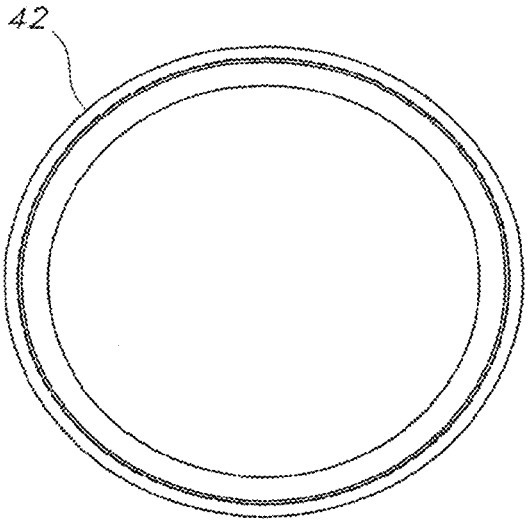
Figure 8C:
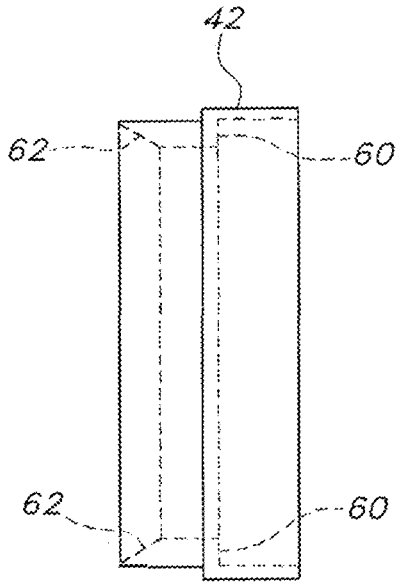
Figure 8D:
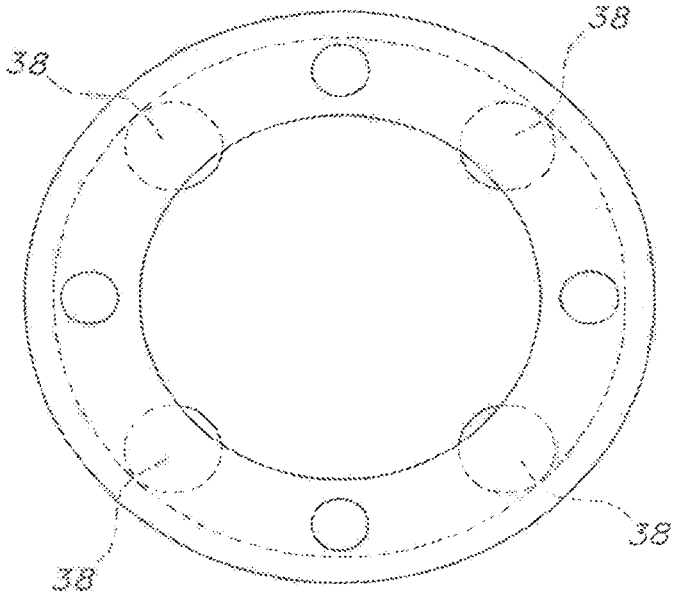
FIGS. 8D-8E schematically show an example of an upper receiver coupling component in unlocked and locked configurations respectively.
Figure 8E:
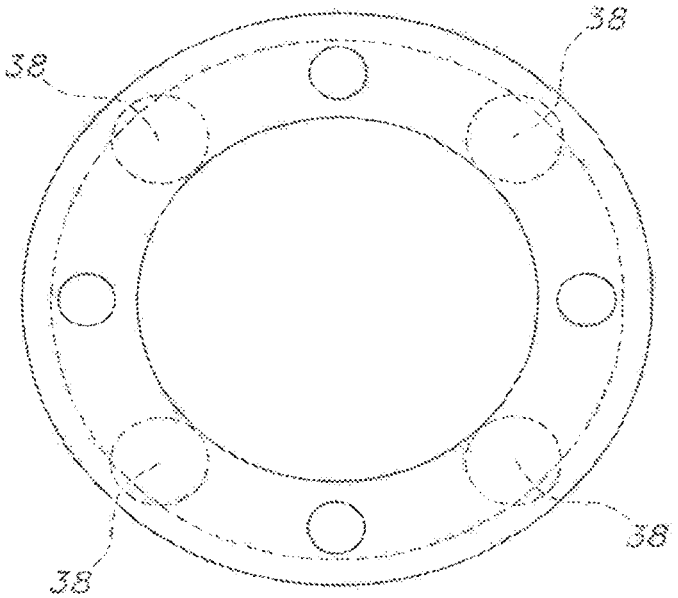

FIGS. 8A-8C show the sliding lock collar 42 of FIG. 6 in further detail. The collar 42 has an opening extending through it with an innermost internal diameter of sufficient dimension to allow the collar 42 to fit over a portion of the body 36 in a sliding fashion. The collar 42 may be slid in a translational motion along the body 36 (e.g. straight along the body 36 without rotation of the collar 42 relative to the body 36).

The opening of collar 42 includes a recessed area terminating at shoulder 60 at one end of the collar 42. The recess is configured to contain the resilient element 40 shown in FIG. 6, with one end of the element 40 acting against shoulder 56 and the other end of the element 40 acting against shoulder 60 such that collar 42 is biased away from the shoulder 56 of body 36 towards the other end of the body 36.

The opening of collar 42 also includes a second recess at the other end of the collar 42. In this particular example, second recess is formed by ramped surface 62. When the collar 42 is biased away from the shoulder 56 of body 36, the ramped surface 62 acts on locking elements 38 to cause those elements to protrude into the openings 46 of body 36 (see FIG. 8D) in a locked position. When the collar 42 is pulled back against the bias of resilient element 40, the locking elements 38 are unlocked and can move out of the openings 46 (see FIG. 8E).

Figure 9A:
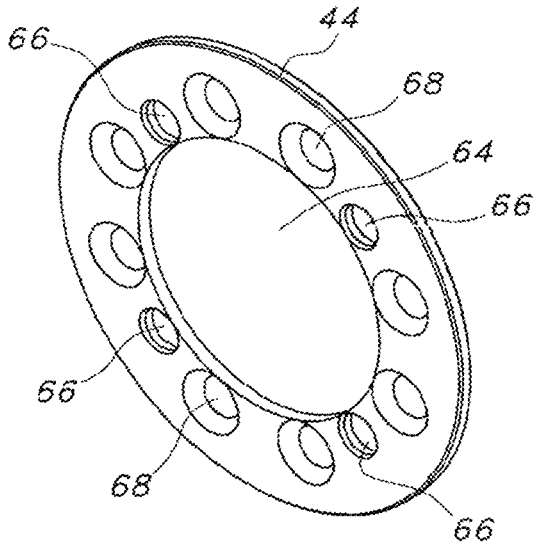
FIGS. 9A-9C show an example of a face plate of an upper receiver coupling component.
Figure 9B:
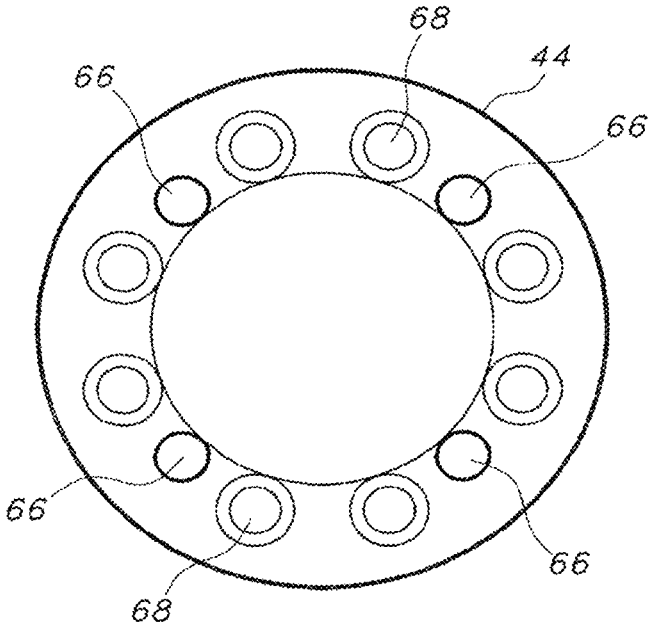
Figure 9C:
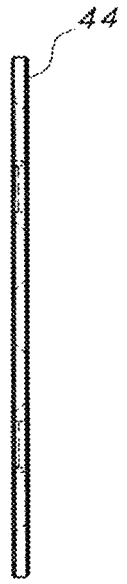

FIGS. 9A-9C show the face plate 44 of FIG. 6 in more detail. The face plate includes a central opening 64 and tunnel portions 66 corresponding to the opening 46 and tunnels 54 of body 36. The outer diameter of the face plate 44 is of sufficient size so that when it is secured to the end of body 36 (e.g. using fasteners passing through fastener openings 68 in face plate 44 and into openings 58 in body 36), the face plate 44 limits the sliding movement of collar 42 away from the shoulder 56 of body 36.

Figure 10A:
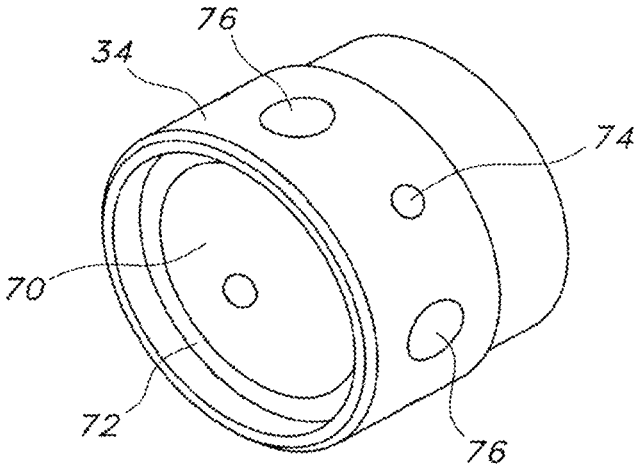
FIGS. 10A-10C show an example of a barrel coupling component.
Figure 10B:
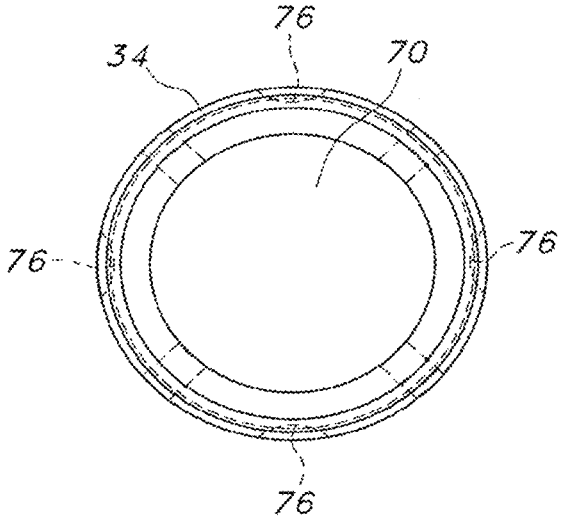
Figure 10C:
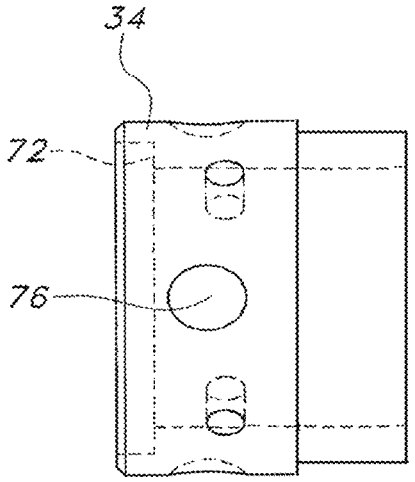

FIGS. 10A-10C show the barrel coupling 34 of FIG. 5 in more detail. The barrel coupling 34 includes an opening 70 extending through it for receiving the barrel 12 of a firearm. In the particular example shown, the opening 70 includes a recessed area 72 that partially or entirely receives a ridge on the barrel 12 such that the barrel coupling 34 can be slid over the barrel 12 and receive the barrel ridge in the recessed area 72 such that the reference surface 28 (e.g. a rear surface of the barrel ridge) is flush with or slightly proud of the end of barrel coupling 34 (see FIG. 11). Recessed area 72 can also be seen in FIGS. 5C-5E. Returning to FIGS. 10A-10C, the barrel coupling 34 includes fastener openings 74 for receiving fasteners to further secure the barrel coupling in position on the barrel 12.

The barrel coupling 34 further includes several locking element receivers 76 spaced apart from one another and configured and located to receive portions of locking elements 38 during use. In the particular example shown, the locking element receivers 76 are depressions in the outer surface of the barrel coupling 34. In the particular example shown, the spaced apart locking elements 38 and locking element receivers 76 help to resist rotation or the movement or forces of the upper receiver coupling 32 relative to the barrel coupling 34 when the components are locked together.

Figure 11:
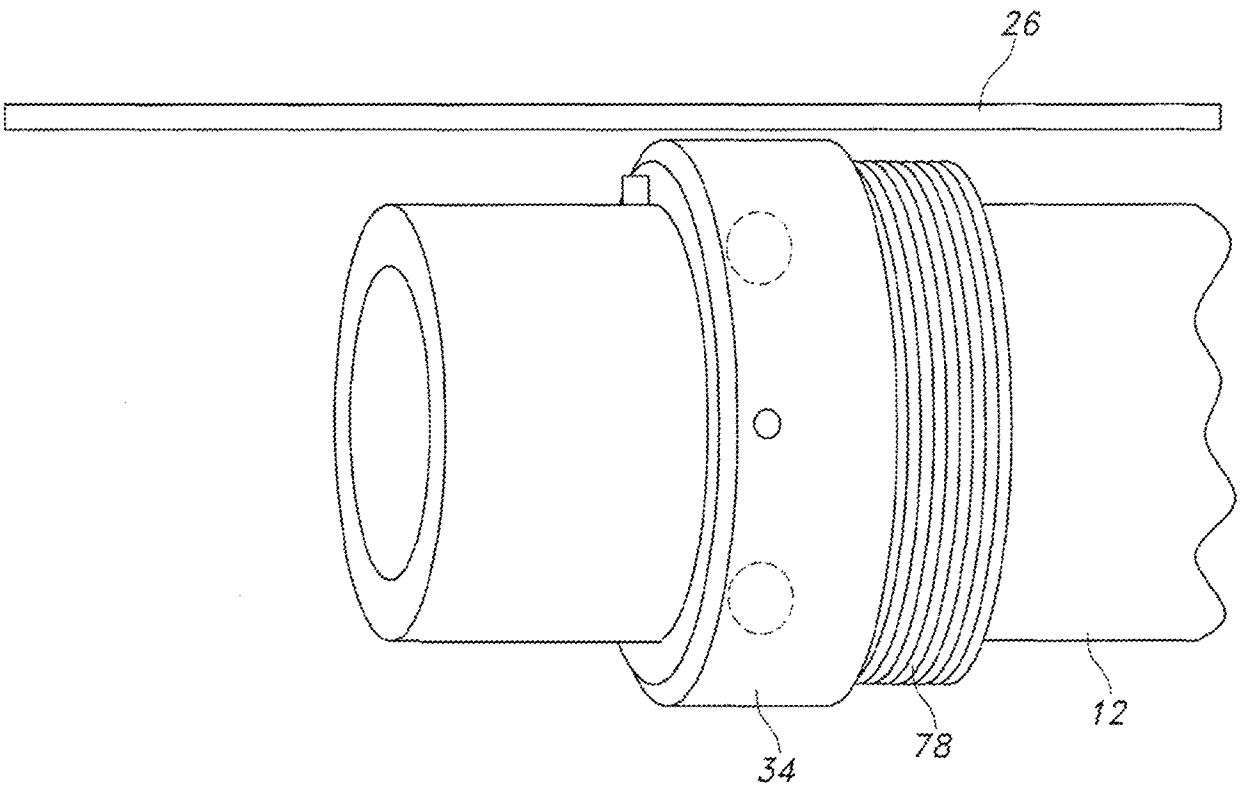
FIG. 11 schematically shows an example of a barrel coupling component mounted on a barrel.

The barrel coupling 34 further includes threads 78 on a portion of its outer surface. Threads 78 are not shown in FIG. 10 but are shown in FIG. 11. The pitch, thread angle, and other characteristics (e.g. major diameter, minor diameter) of the threads 78 of barrel coupling 34 are the same or substantially the same as the pitch, thread angle, and other characteristics of the threads 18 of upper receiver 10. Because these thread characteristics are the same or substantially the same, barrel and/or handguard nuts or other connectors useable with the upper receiver threads 18 are also useable with the barrel coupling threads 78, meaning that handguards and other components that were usable with the upper receiver 10 can still be used with the firearm after installation of the upper receiver coupling 32 and barrel coupling 34 without necessarily requiring modification of those components or additional adaptors.

Figure 12:
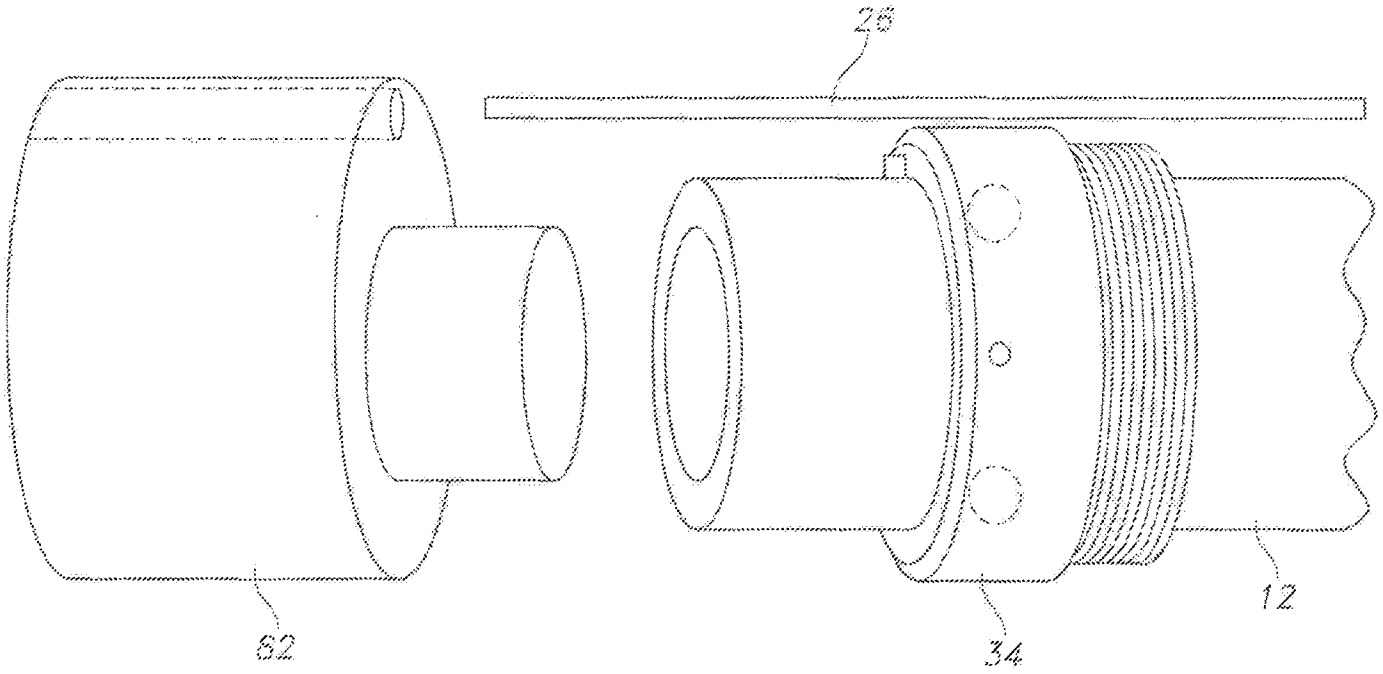
FIG. 12 schematically shows an example of a protective cap for a gas tube and barrel end.

FIG. 12 illustrates an example of a protective cap 82 for protecting the end of gas tube 26 (or a piston) when the firearm is disassembled.

Example Method of Installation

The following is one example of a method of installing the quick-take down coupling shown in FIGS. 5-12.

The upper receiver coupling 32 may be installed onto the upper receiver 10 by threading the upper receiver coupling 32 onto the upper receiver threads 18 to a desired torque and such that one of the tunnels 54 of the upper receiver coupling 32 is adequately aligned with the opening 24 in upper receiver 10. Set screws or other fasteners may be inserted into openings 50 in body 36 to further secure the upper receiver coupling 32 to the upper receiver threads 18.

The barrel coupling 34 may be installed onto the barrel 12 by sliding the coupling 34 onto the barrel until the barrel ridge is partially or entirely received in recessed area 72, with the reference surface 28 of the barrel ridge coplanar or just proud of the end of barrel coupling 34 and barrel pin 30 adjacent or proximate the barrel coupling 34. Set screws or other fasteners may be inserted into openings 74 in coupling 34 to further secure it to the barrel 12.

A handguard and/or barrel nut (e.g. 80 in FIG. 5A) may be threaded onto the barrel coupling 34 (in some instances, this may be done prior to securing the barrel coupling 34 to barrel 12). A gas tube (e.g. 26 in FIG. 5A) or piston may be installed on barrel 12, with an end of the gas tube or piston extending through an opening in the handguard/barrel nut 80, and a handguard (e.g. 14 in FIG. 5A) may be installed onto the handguard/barrel nut 80.

Example Method of Use

The following is one example of a method of using the quick-take down coupling shown in FIGS. 5-12 after installation onto a firearm.

Protective cap 82 may be removed from the end of gas tube 26 and barrel 12.

Sliding lock collar 42 may be slid using a translational motion (e.g. non-rotational) back towards the upper receiver 10 to an unlocked position that releases the locking elements 38 inside of the upper receiver coupling 32.

While the sliding lock collar 42 is held at the unlocked position, the barrel 12 may be inserted into the upper receiver 10. The barrel 12 is inserted until the barrel reference surface 28 contacts the upper receiver contact surface 22, with the barrel pin 30 seated in notch 20. During insertion of the barrel, gas tube 26 (or a piston) is also inserted through one of the tunnels 54 in the upper receiver coupling 32 and into opening 24 in the upper receiver 10. Once inserted, the locking element receivers 76 of the barrel coupling 34 are aligned with the locking elements 38 of the upper receiver coupling 32.

Once inserted, the sliding lock collar 42 is released such that resilient element 40 forces the sliding lock collar 42 back to a locked position, causing the locking elements 38 to engage the locking element receivers 76, securing the barrel 12 to the upper receiver 10.

The barrel 12 may be removed from the upper receiver 10 using the same procedure in reverse.

Integrated Quick Take-Down Coupling

Figure 13:
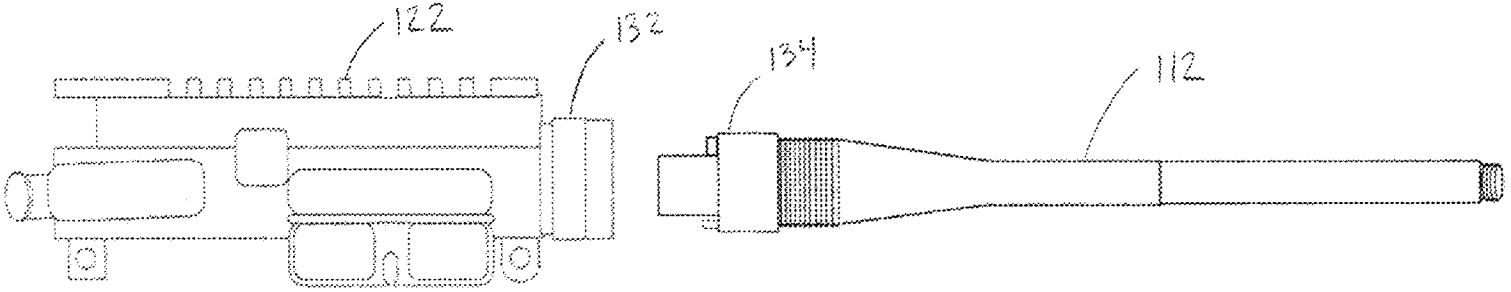
FIG. 13 shows an example of a quick take-down coupling that is integrated into the upper receiver and barrel of a firearm, shown with the barrel un-coupled from the upper receiver.
Figure 14:
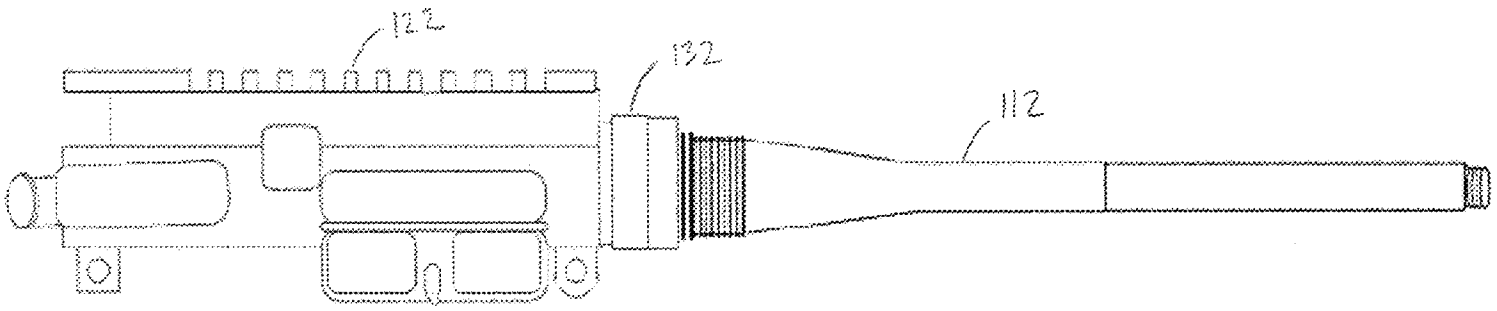
FIG. 14 shows the firearm of FIG. 13 with the barrel coupled to the upper receiver.
Figure 15:
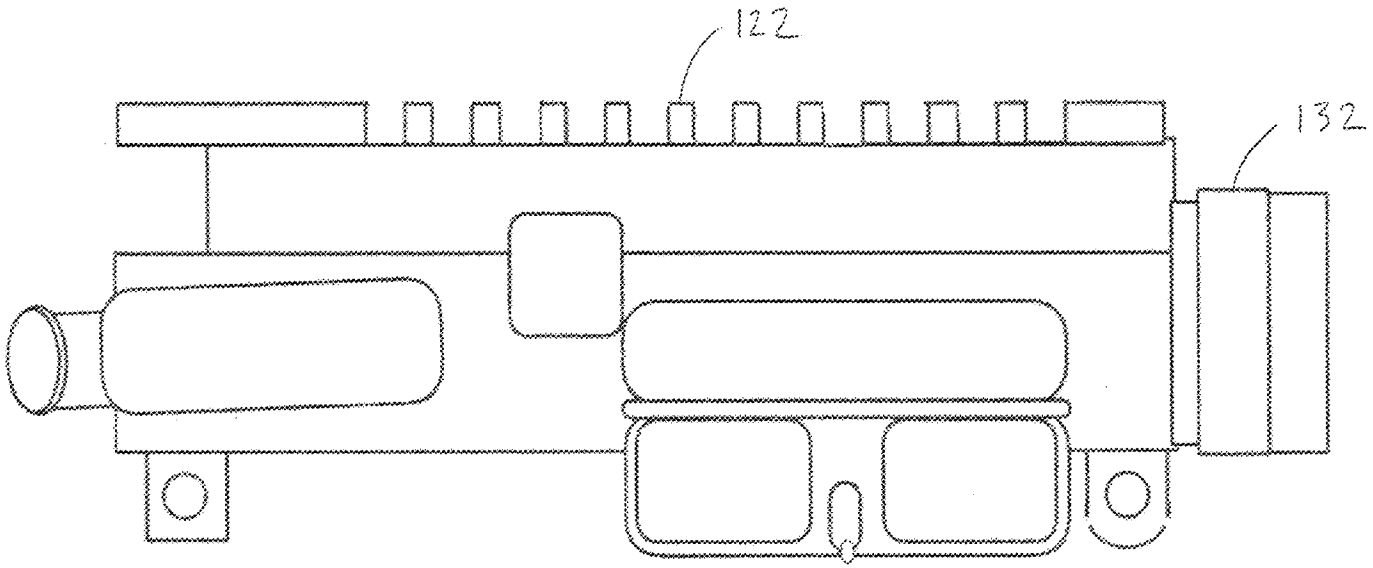
FIG. 15 shows the upper receiver of the firearm of FIG. 13.

FIGS. 13 through 21 show examples of firearms with quick-take down couplings that have been integrated into the firearm when it is manufactured. In FIGS. 13-21, the upper receiver coupling 132 and the barrel coupling 134 are integral components of the firearm that are incorporated into the upper receiver 122 and barrel 112 at the time of manufacture. In other examples, both components are not integral. For example, a quick take-down firearm could include an upper receiver with a non-integral coupling component (such as shown in FIGS. 5-6) and a barrel with an integral coupling component (such as shown in FIGS. 13-14). In other examples, the barrel coupling component could be non-integral and the upper receiver coupling component could be integral.

Figure 16:
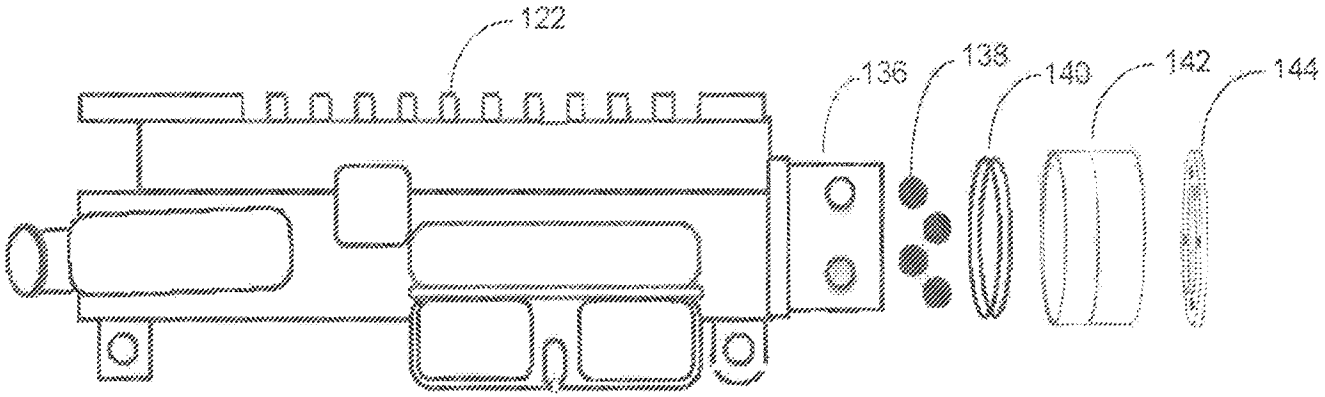
FIG. 16 shows the components of the integrated upper receiver coupling of FIG. 13.

FIG. 16 shows the components of the upper receiver coupling 132. As with the upper receiver coupling 32 shown in FIG. 6, the upper receiver coupling 132 of FIG. 16 includes a body 136, locking elements 138, resilient element 140, sliding lock collar 142, and face plate 144. The body 136 may be an integral part of the upper receiver 122 (e.g. machined, molded, forged, etc. from the same material and at the same time as the rest of the upper receiver). Alternatively, the body 136 may be secured to the upper receiver 122 in other ways, such as how the body 36 is secured to the upper receiver 12 in earlier examples.

Figure 17B:
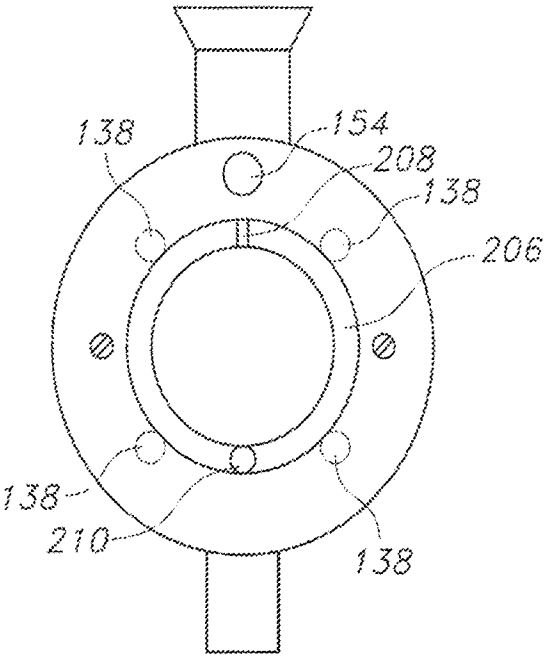
FIGS. 17A-17B show the integrated upper receiver coupling of FIG. 13 in more detail.
Figure 17A:
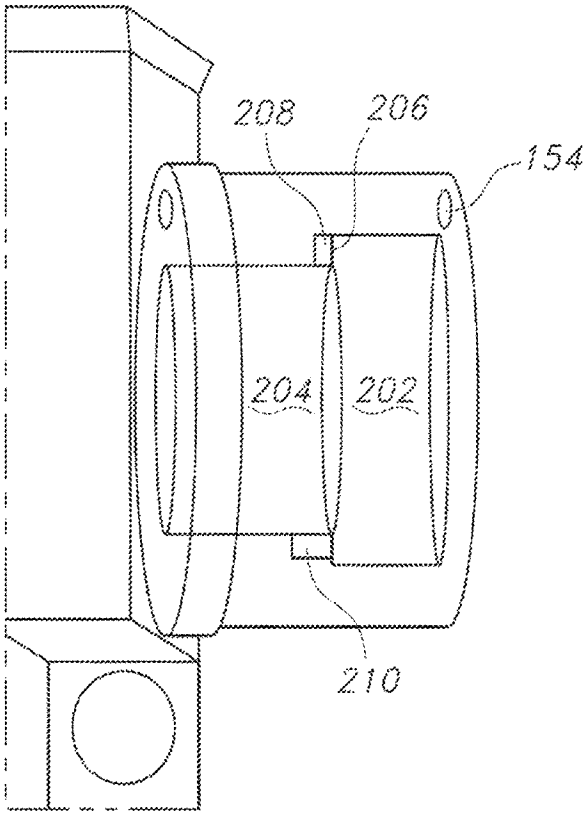

FIGS. 17A and 17B show additional features of the body 136. The body 136 includes a cavity with a stepped-down interior diameter having a larger interior diameter portion 202 that receives the coupling 134 of the barrel 112 and a smaller diameter portion 204 that receives an end of barrel 112. At the shoulder 206 where the cavity steps down in diameter there is an alignment protrusion receiver 208 (e.g. a notch) that receives an alignment protrusion (e.g. a pin) of the barrel 112, which is discussed further below. At the shoulder 206, there is also an opening 210 for receiving an anti-rotation feature, which is also discussed further below. As shown in FIGS. 17A and 17B, the body 136 also includes a tunnel 154 extending through the body, configured to allow passage of a gas tube or piston associated with the barrel 112 into the upper receiver 122.

Figure 18:
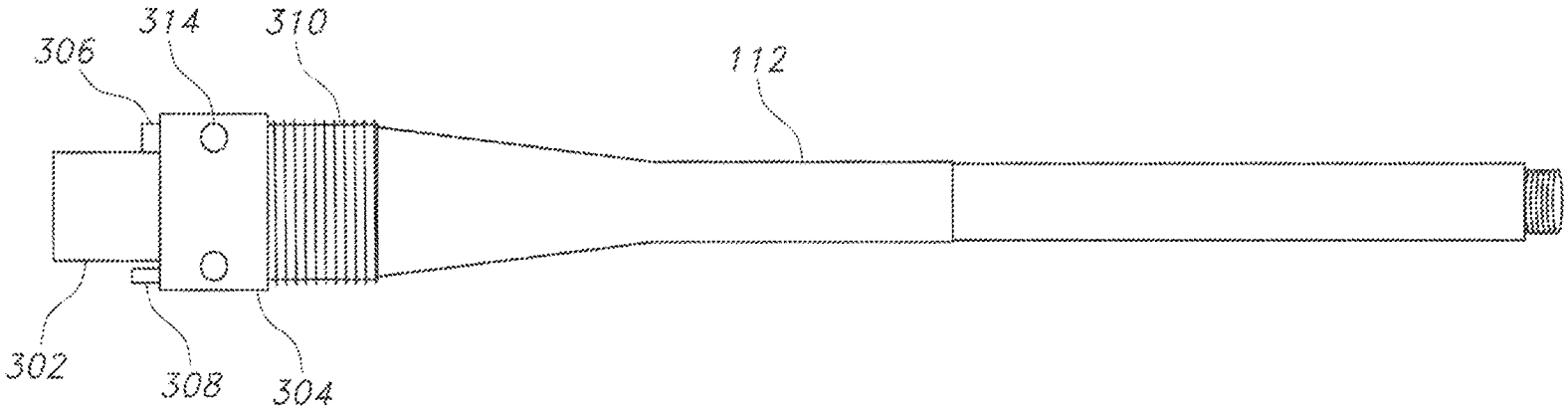
FIG. 18 shows the barrel of the firearm of FIG. 13.
Figure 19:
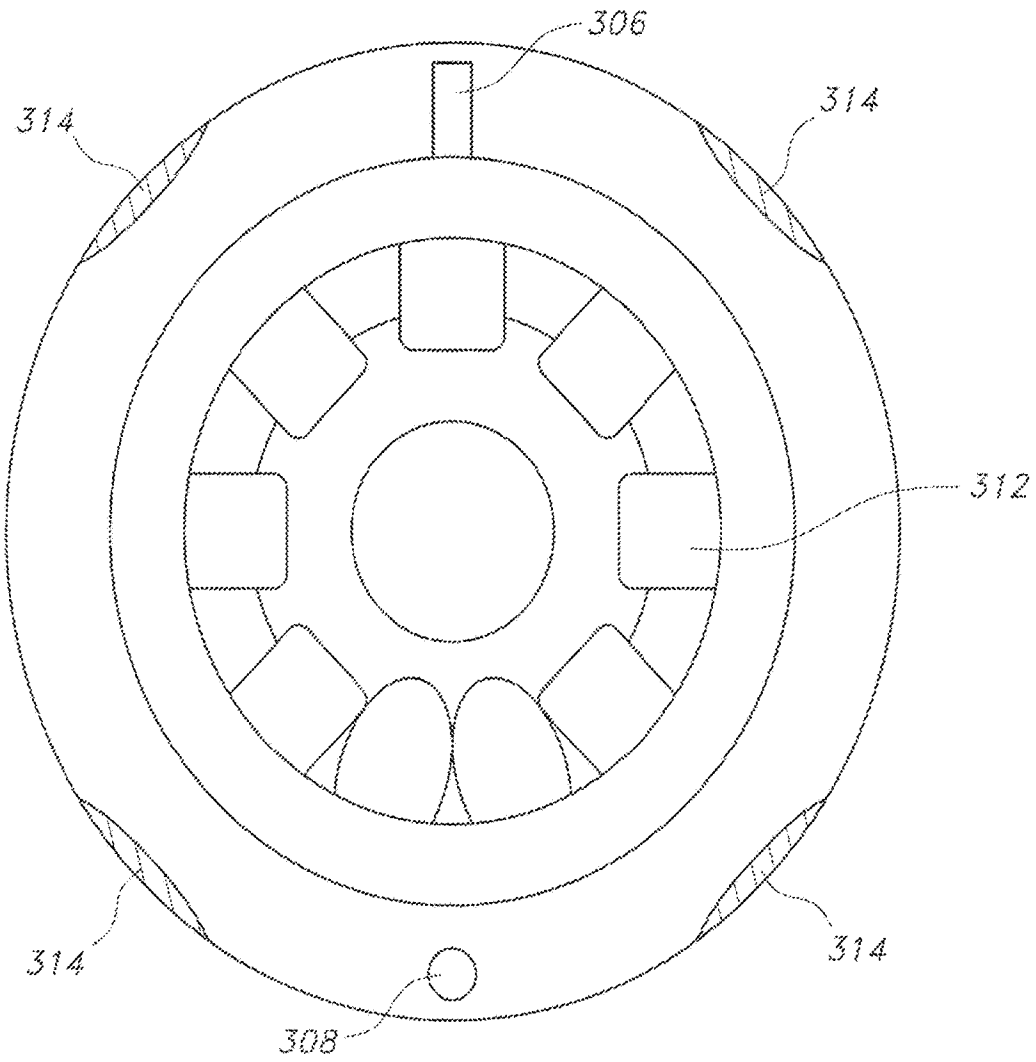
FIG. 19 shows an end view of the barrel of FIG. 18.
Figure 20:
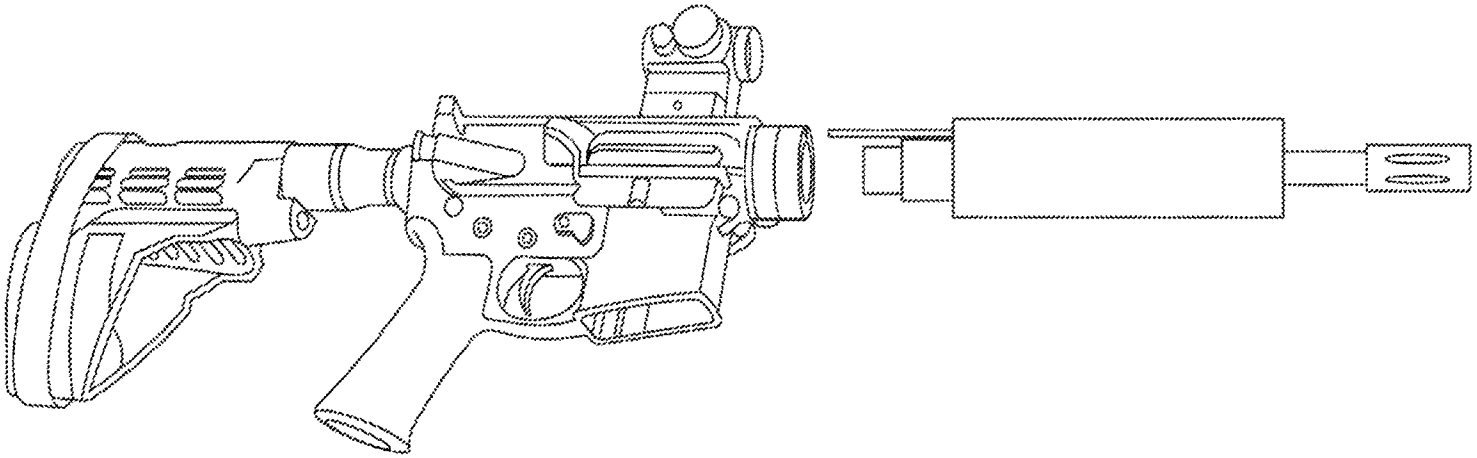
FIG. 20 shows another example of a firearm with an integrated quick take-down coupling, shown with the barrel uncoupled from the upper receiver.
Figure 21:
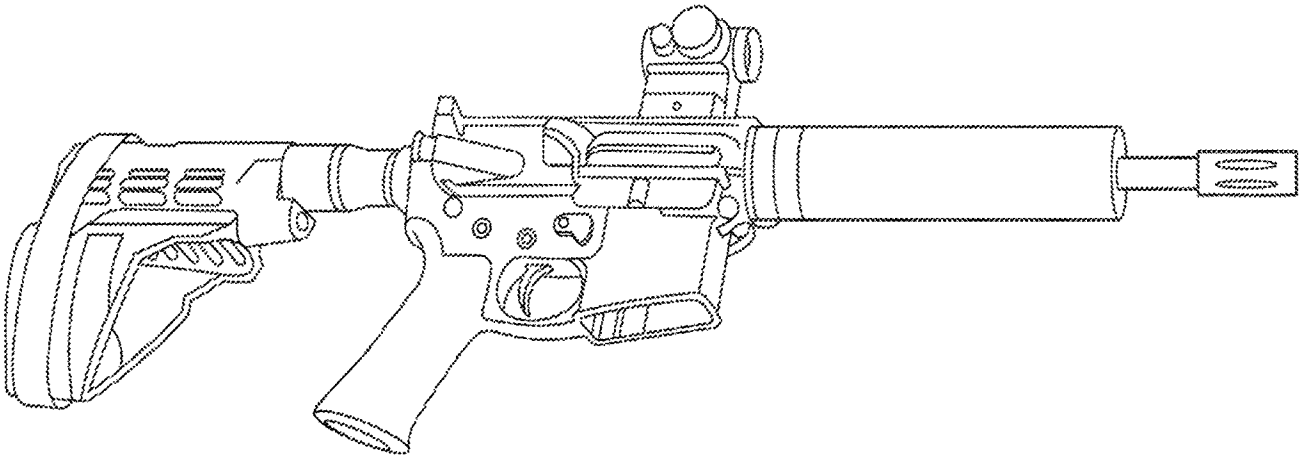
FIG. 21 shows the firearm of FIG. 20 with the barrel coupled to the upper receiver.

FIGS. 18 and 19 show additional features of the barrel 112. The barrel 112 includes a portion 302 configured for insertion into the smaller diameter portion of the body 204 connected to the upper receiver 122. The barrel 112 also has a larger diameter coupling portion 304 including at least one depression (FIG. 18 shows multiple depressions) for engaging the locking elements 138 of the upper receiver coupling. At a shoulder where the barrel extension 302 meets the coupling portion 304 there is an alignment pin 306 and a counter-rotation feature 308 that fit into the notch 208 and opening 210 respectively in the body 136 of the upper receiver coupling, which properly align the barrel 112 to the upper receiver 122 (both rotationally and insertion depth) when assembled. The barrel also includes external threading 310 for securing a handguard to the barrel (e.g. as shown in FIGS. 20 and 21). In some embodiments, the external threading 310 is MILSPEC or other standardized threading allowing it to be used with standard barrel nuts or other threaded components for attaching a handguard to the barrel. As shown in FIG. 19, the barrel includes lugs 312 that interact with the lugs on the bolt when a round is chambered.

Barrel Extension With Quick Take-Down Coupling

Figure 22:
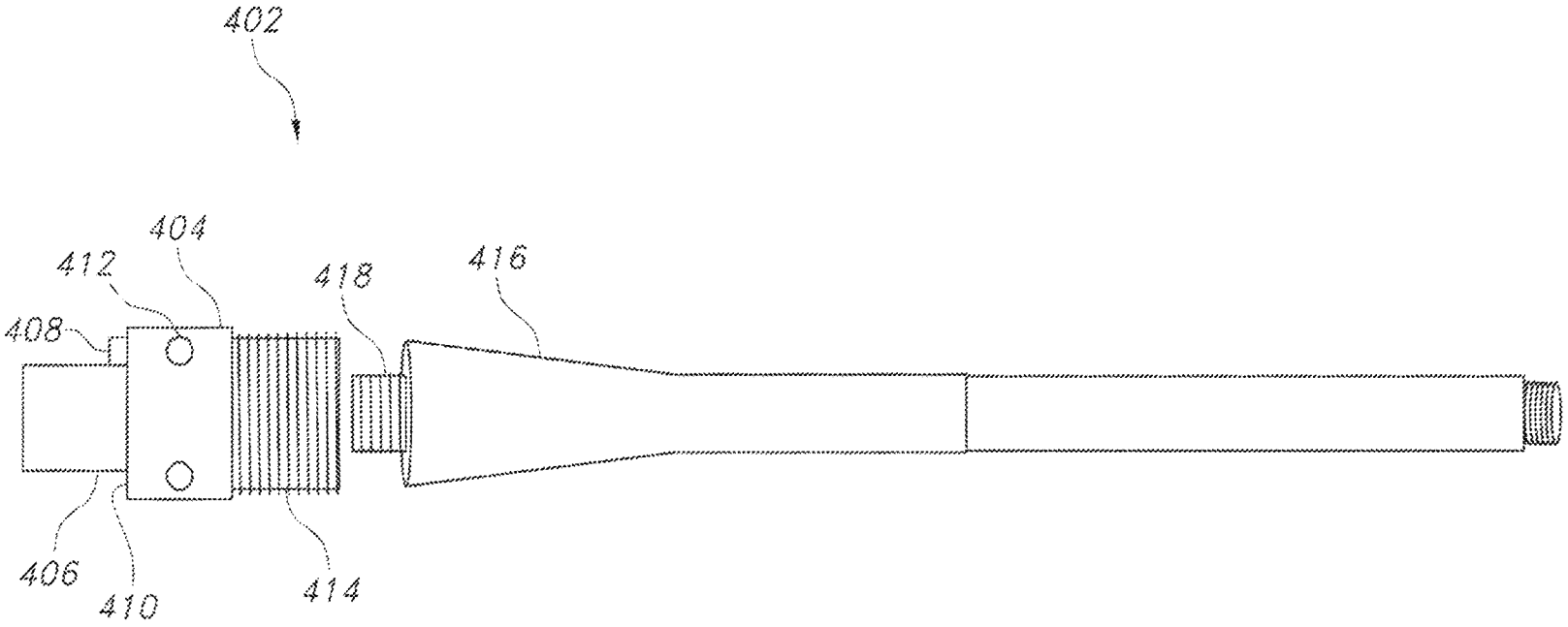
FIG. 22 shows another example of a barrel for a quick take-down firearm.
Figure 23:
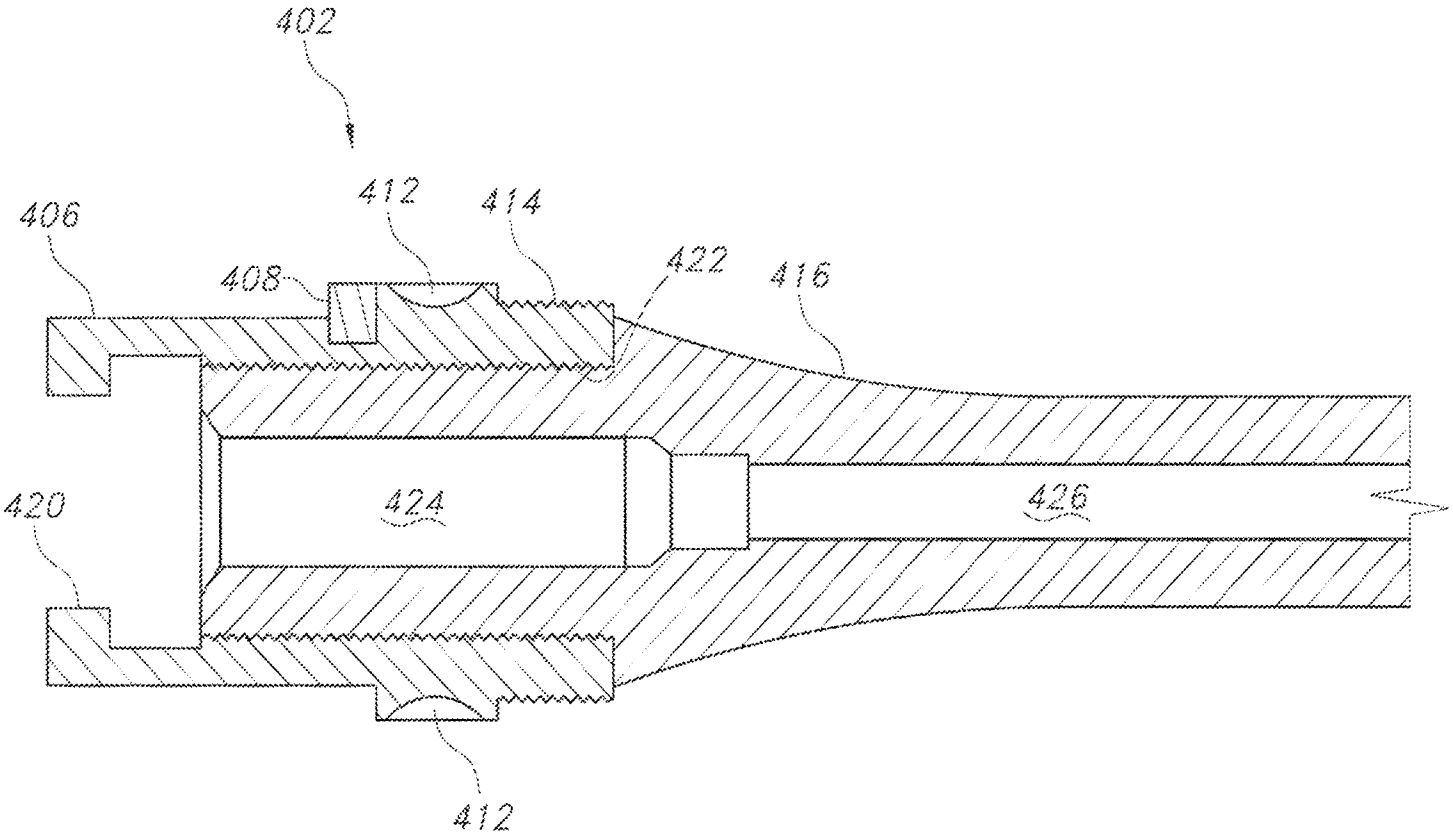
FIG. 23 shows a cross section of another example of a barrel for a quick take-down firearm.

FIGS. 22 and 23 show examples of barrels that have barrel extensions 402, in which the barrel extension 402 includes a quick take-down coupling 404.

In FIG. 22, the barrel extension 402 includes, from left to right, a cylindrical insertion surface 406 for insertion into the firearm's upper receiver, an alignment protrusion 408 (e.g. alignment pin) that fits into a notch of the upper receiver to rotationally align (and prevent rotation of) the barrel relative to the upper receiver, a reference surface 410 (e.g. a shoulder) limiting the insertion depth of the barrel into the upper receiver, the quick take-down coupling portion 404 of the barrel extension (including depressions 412) for engaging the locking elements of the quick take-down coupling of the upper receiver, and external threading 414 for securing a handguard. As also shown in FIG. 22, the barrel includes an elongated barrel portion 416 that secures to the barrel extension 402 by threading 418.

FIG. 23 shows an example of a barrel extension 402 and part of an elongated barrel 416 in cross section. As shown in FIG. 23, internal features of the barrel extension 402 include lugs 420 for interacting with the lugs of a bolt when a round is chambered, and internal threading 422 for engaging the threading 418 on the elongated barrel. FIG. 23 also shows internal features of the elongated barrel 416 including the chamber 424 for receiving a round of ammunition and the bore 426 of the barrel.

FIGS. 24-28B show an embodiment of a quick detach facility for a firearm 500. More particularly, the quick detach facility for a firearm that can be used with the firearm of FIGS. 1-4 to provide quick and easy installation and removal of the barrel 12 from the upper receiver/frame 10. The quick detach facility of FIGS. 24-28B includes an upper receiver coupling/first connection assembly 532 associated with the upper receiver/frame 10 and a second connection assembly 502 associated with the barrel 12. The second connection assembly includes a barrel coupling 534, shim 504, and inner ring 506. The upper receiver coupling 532 secures to the threads 18 of the upper receiver. The barrel coupling 534 secures to the barrel 12 proximate the reference surface 28 and pin 30. The quick detach facility has a locking/mating mechanism, described in further detail below, for locking and unlocking the upper receiver coupling 532 from the barrel coupling 534, providing for quick and easy installation and removal of the barrel 12 from the upper receiver 10. Thus, the first and second connection assemblies are selectively matable with each other and have a mating mechanism movable between a released position in which the first and second connection assemblies are separable from each other and a locked position in which the first and second connection assemblies are secured to each other for firearm operation.

The barrel 12 includes a central bore 524 that defines a forward rifled portion 526, a rearward chamber portion 528, and a barrel axis 530.

Figure 24:
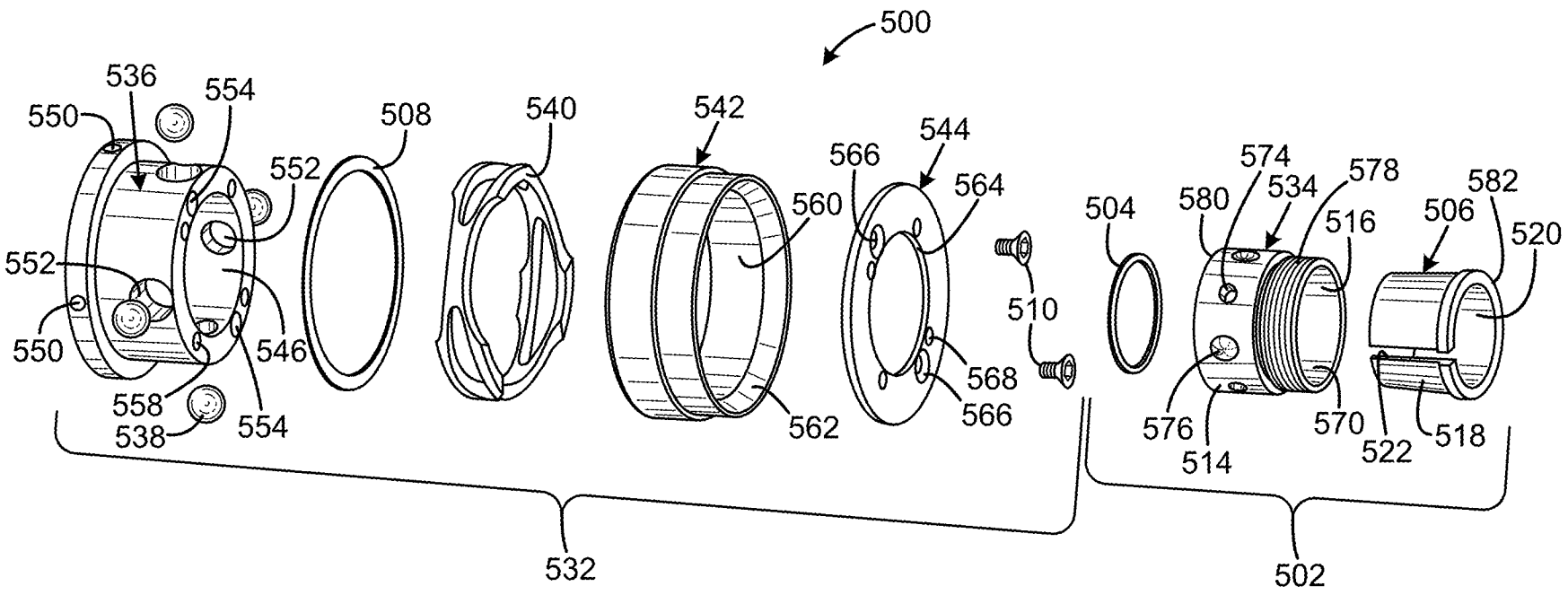
FIG. 24 shows an exploded view of an embodiment of a quick detach facility for a firearm.
Figure 25:
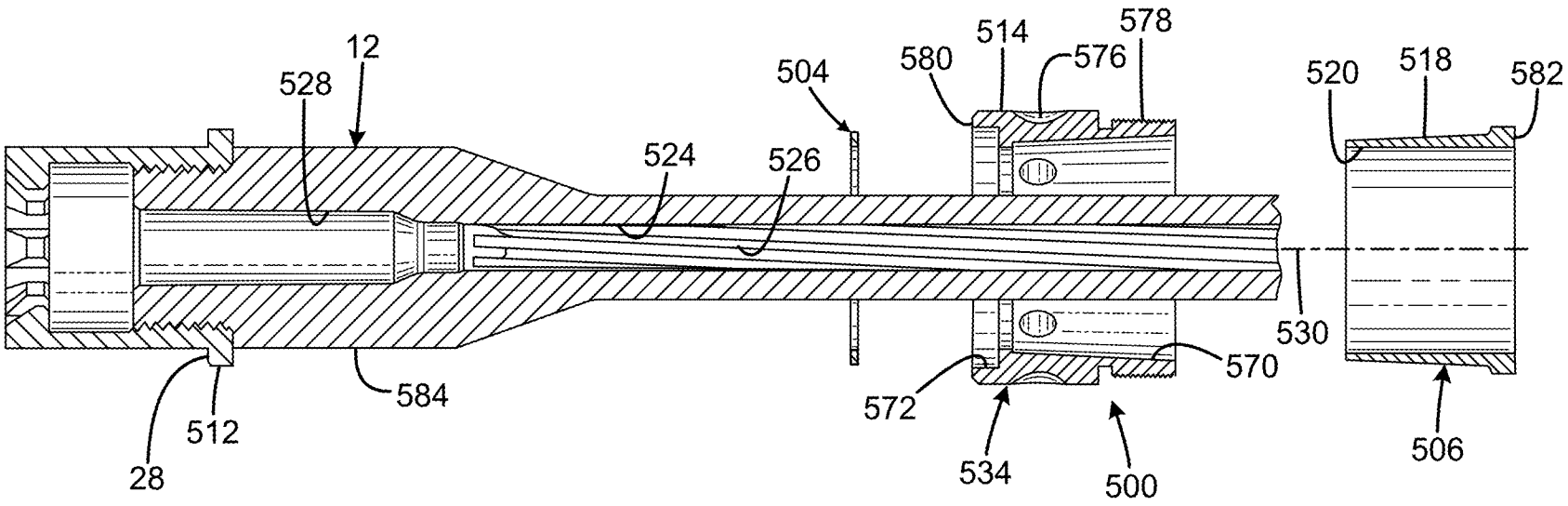
FIG. 25 shows an exploded sectional view of the embodiment of a quick detach facility for a firearm of FIG. 24 with a barrel.
Figure 26:
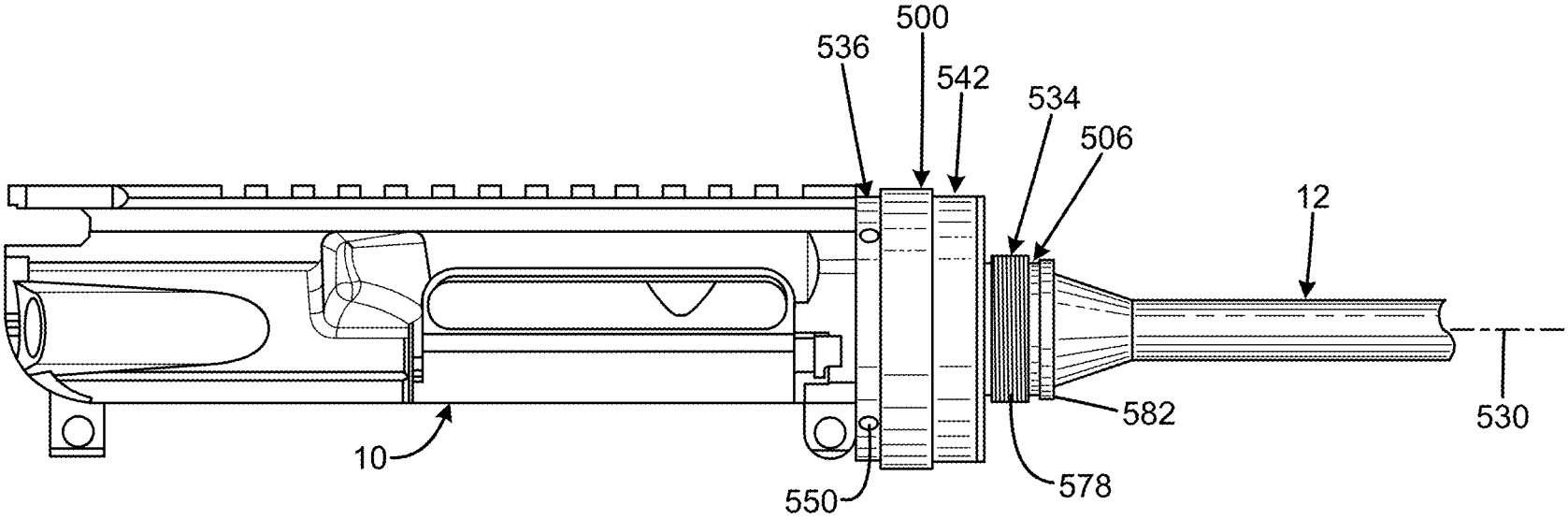
FIG. 26 shows a right side view of the embodiment of a quick detach facility for a firearm of FIG. 24 attaching the barrel of FIG. 25 to a frame/upper receiver.

The upper receiver coupling 532 includes, from left to right, a body 536, latch/locking elements 538, shim 508, resilient element 540, sliding/movable lock collar 542, face plate 544, and screws 510. The resilient element 540 is shown in FIG. 24 as a wave spring, although other types of resilient elements may be used, such as a coil spring. The screws releasably secure the face plate to the body.

The body 536 includes an opening 546 extending through it from one end to the other. At least a portion of the opening 546 includes interior threading 548 (see FIGS. 27B & 28B), which is configured to engage the exterior threading 18 of the upper receiver 10. In other words, the pitch, thread angle, major diameter, minor diameter, etc. of the threading 548 of the body 536 is configured to correspond with the pitch, thread angle, major diameter, minor diameter, etc. of the threading 18 of the upper receiver 10. In some embodiments, the body threading 548 is MILSPEC or other standardized threading allowing it to be installed on a wide variety of commercially available firearms. The body 536 of also includes through holes 550 around the perimeter of the body 36 for receiving set screws or similar items to further secure the upper receiver coupling 532 to the upper receiver threads 18. In some embodiments, the set screws used may be nylon or another relatively soft material to lessen the risk of damaging the upper receiver threads 18.

The body 536 further includes latch passages/apertures 552 spaced around the body 536 each configured to receive latch/locking elements 538 (e.g. ball bearings) such that portions of the locking elements may protrude into the opening 546 of the body 536 when the upper receiver coupling 532 is in a locked configuration (discussed further below). As shown in FIGS. 27B & 28B, the apertures taper so that, in cooperation with the shape of the locking elements 538, the amount of penetration of the locking elements 538 into the opening 546 is limited.

The body 536 further includes several tunnels 554 extending through the length of the body from one end to the other. The tunnels 554 are configured to allow passage of a gas tube or piston associated with the barrel 12 through the body 536 and into the opening 24 on the upper receiver. As shown in FIG. 24, the tunnels 554 are rotationally offset from one another (in this example, there are two tunnels 554 spaced apart 180 degrees from each other) and also rotationally offset from the apertures 552 in the body 536. In this example, the tunnels 554 are rotationally offset to allow for proper alignment of one of the tunnels 554 with the opening 24 in the upper receiver 10 when the upper receiver coupling 532 is secured to the upper receiver threads 18 at a desired torque or within a desired torque range.

In other embodiments, tunnels are not necessary. For example, in some embodiments, the quick detach facility may be used with an AR Pistol or other firearm that uses direct blowback cycling, without the need for a gas tube or piston.

The body 536 further includes a flange or shoulder 556 and openings 558, the purposes of which will be described further below. A shim 508 abuts the shoulder 556.

The sliding lock collar 542 of FIG. 24 has an opening extending through it with an innermost internal diameter of sufficient dimension to allow the collar 542 to fit over a portion of the body 536 in a sliding fashion. The collar 542 may be slid in a translational motion along the body 536 (e.g. straight along the body 536 without rotation of the collar 542 relative to the body 536).

The opening of collar 542 includes a recessed area terminating at shoulder 560 at one end of the collar 542. The recess is configured to contain the resilient element 540, with one end of the element 540 acting against shoulder 556 and the other end of the element 540 acting against shoulder 560 such that collar 542 is biased away from the shoulder 556 of body 536 towards the other end of the body 536.

The opening of collar 542 also includes a second recess at the other end of the collar 542. In this particular example, the second recess is formed by tapered inner surface/ramped surface 562 adapted to bear on the locking elements 538. When the collar 542 is biased away from the shoulder 556 of body 536, the ramped surface 562 acts on locking elements 538 to cause those elements to protrude into the openings 546 of body 536 (see FIGS. 27A & 27B) in a locked position. When the collar 542 is pulled back against the bias of resilient element 540 into a retracted, the locking elements 538 are unlocked and can move out of the opening 546 (see FIGS. 28A & 28B) away from the barrel axis 530 to enable the mating mechanism to move to the released position.

The face plate 544 includes a central opening 564 and tunnel portions 566 corresponding to the opening 546 and tunnels 554 of body 536. The outer diameter of the face plate 544 is of sufficient size so that when it is secured to the end of body 536 (e.g. using fasteners/screws 510 passing through fastener openings 568 in face plate 544 and into openings 558 in body 536), the face plate 544 limits the sliding movement of collar 542 away from the shoulder 556 of body 536.

The outer ring/barrel coupling 534 includes an opening 570 extending through it for receiving the barrel 12 of a firearm. In the particular example shown, the opening 570 includes a recessed area 572 (shown in FIGS. 25, 27B & 28B) that partially or entirely receives a barrel ridge 512 on the barrel 12 such that the barrel coupling 534 can be slid over the barrel 12 and receive the barrel ridge in the recessed area 572 such that the reference surface 28 (e.g. a rear surface of the barrel ridge) is flush with or slightly proud of the end of barrel coupling 534 (see FIGS. 27B & 28B). A shim 504 is captured in the recessed area 572 between the barrel ridge and the barrel coupling. The barrel coupling 534 includes fastener openings 574 for receiving fasteners to further secure the barrel coupling in position on the barrel 12.

The barrel coupling 534 further includes several latch receptacles/locking element receivers 576 spaced apart from one another and configured and located to receive portions of locking elements 538 during use. In the particular example shown, the locking element receivers 576 are spherical depressions in the outer surface 514 of the barrel coupling 534. In the particular example shown, the spaced apart locking elements 538 and locking element receivers 576 help to resist rotation or the movement or forces of the upper receiver coupling 532 relative to the barrel coupling 534 when the components are locked together.

The barrel coupling 534 further includes threads 578 on a portion of its outer surface 514. The pitch, thread angle, and other characteristics (e.g. major diameter, minor diameter) of the threads 578 of barrel coupling 534 are the same or substantially the same as the pitch, thread angle, and other characteristics of the threads 18 of upper receiver 10. Because these thread characteristics are the same or substantially the same, barrel and/or handguard nuts or other connectors useable with the upper receiver threads 18 are also useable with the barrel coupling threads 578, meaning that handguards and other components that were usable with the upper receiver 10 can still be used with the firearm after installation of the upper receiver coupling 532 and barrel coupling 534 without necessarily requiring modification of those components or additional adaptors.

A forward portion of the opening 570 in the barrel coupling 574 defines a tapered inner surface 516 configured to closely receive the tapered outer surface 518 of the inner ring 506. The inner ring 506 has a cylindrical inner surface 520 configured to closely contact a selected portion of the barrel 12. The inner ring is a split ring having a rearward-facing gap 522 adapted to accommodate a range of barrel diameters. The tapered outer surface 518 of the inner ring 506 is a conical surface. In the current embodiment, the tapered outer surface 518 of the inner ring 506 has a taper angle offset from the barrel axis 530 of at least 1° and at most 20°. For an expected best preferred range of performance for AR-15, AR Pistols, M4, M16 and similar prior art MILSPEC firearm platforms, the tapered outer surface 518 of the inner ring 506 has a taper angle offset from the barrel axis 530 of between 1° and 10°. The tapered outer surface 518 of the inner ring 506 and the tapered inner surface 516 of the barrel coupling 534 have a common shape such that they have an extensive surface of contact. The tapered outer surface 518 of the inner ring 506 and the tapered inner surface 516 of the barrel coupling 534 have a common taper angle. The barrel coupling 534 has a rear shoulder surface 580 configured to bear against the barrel ridge/barrel shoulder 512, and the inner ring 506 has a forward bearing surface 582 configured for application of a rearward axial assembly force to advance the inner ring 506 into the space defined between the inner tapered surface 516 of the barrel coupling 534 and the outer surface 584 of the barrel 12. As is denoted by the force arrows in FIGS. 27B & 28B, as the inner ring 506 pushes rearward on the barrel coupling 534 during installation of the barrel coupling on the barrel 12, an opposing force results when the shim 504 is compressed between the barrel coupling 534 and the barrel ridge 512. Thus, the barrel coupling 534 is in circumferential tension and applies an inward compressive force to the inner ring 506. The interaction between the barrel coupling 534 and inner ring 506 enables better system tuning during installation of the barrel coupling 534 on the barrel 12 while allowing looser manufacturing tolerances. Furthermore, the interaction between the barrel coupling 534 and inner ring 506 prevents loosening of the barrel coupling's fit to the barrel 12 over time because of vibrations, temperatures, and deformation during assembly of the barrel coupling to the barrel 12.

In the current embodiment, the tapered outer surface 518 of the inner ring 506 has a self-holding taper angle. For the purposes of the specification, "self-holding" is defined as smaller tapers, like the Morse and the Brown & Sharpe, because, where the angle of the taper is only 2 or 3°, the shank of a tool is so firmly seated in its socket that there is considerable frictional resistance to any force tending to turn or rotate the tool relative to the socket. Thus, a positive locking device is not required to prevent slipping, which makes the use of set screws optional.

Example Method of Installation

The following is one example of a method of installing the quick detach facility shown in FIGS. 24-28B.

The upper receiver coupling 532 may be installed onto the upper receiver 10 by threading the upper receiver coupling 532 onto the upper receiver threads 18 to a desired torque and such that one of the tunnels 554 of the upper receiver coupling 532 is adequately aligned with the opening 24 in upper receiver 10. Set screws or other fasteners may be inserted into openings 550 in body 536 to further secure the upper receiver coupling 532 to the upper receiver threads 18.

The shim 504, inner ring 506, and barrel coupling 534 may be installed onto the barrel 12 by sliding the shim 504, barrel coupling 534, and inner ring 506 onto the barrel until the barrel ridge 512 is partially or entirely received in recessed area 572, with the reference surface 28 of the barrel ridge coplanar or just proud of the end of barrel coupling 354 and barrel pin 30 adjacent or proximate the barrel coupling 534. The shim 504 is captured in the recessed area 572 between the barrel ridge 512 and the barrel coupling 534. A tooling ring can be used to exert rearward pressure on the forward bearing surface 582 of the inner ring 506 to securely seat the inner ring 506 within the barrel coupling 534. Set screws or other fasteners may be inserted into openings 574 in barrel coupling 534 to further secure it to the barrel 12.

A handguard and/or barrel nut (e.g. 80 in FIG. 5A) may be threaded onto the barrel coupling 534 (in some instances, this may be done prior to securing the barrel coupling 534 to barrel 12). A gas tube (e.g. 26 in FIG. 5A) or piston may be installed on barrel 12, with an end of the gas tube or piston extending through an opening in the handguard/barrel nut 80, and a handguard (e.g. 14 in FIG. 5A) may be installed onto the handguard/barrel nut 80.

Example Method of Use

The following is one example of a method of using the quick detach facility shown in FIGS. 24-28B after installation onto a firearm.

Figure 28A:
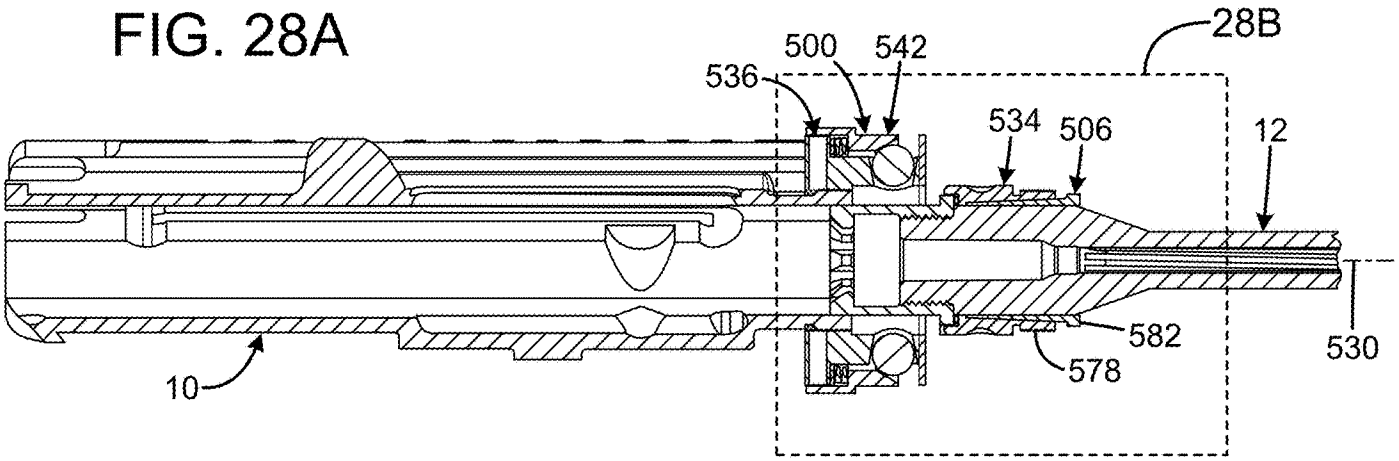
FIG. 28A is a side sectional view of the embodiment of a quick detach facility for a firearm of FIG. 24 showing the barrel of FIG. 25 being detached from the frame/upper receiver of FIG. 26.

Sliding lock collar 542 may be slid using a translational motion (e.g. non-rotational) back towards the upper receiver 10 to an unlocked position shown in FIGS. 28A & 28B that releases the locking elements 538 inside of the upper receiver coupling 532.

While the sliding lock collar 542 is held at the unlocked position, the barrel 12 may be inserted into the upper receiver 10. The barrel 12 is inserted until the barrel reference surface 28 contacts the upper receiver contact surface 22, with the barrel pin 30 seated in notch 20. During insertion of the barrel, gas tube 26 (or a piston) is also inserted through one of the tunnels 554 in the upper receiver coupling 532 and into opening 24 in the upper receiver 10. Once inserted, the locking element receivers 576 of the barrel coupling 534 are aligned with the locking elements 538 of the upper receiver coupling 532.

Figure 27A:
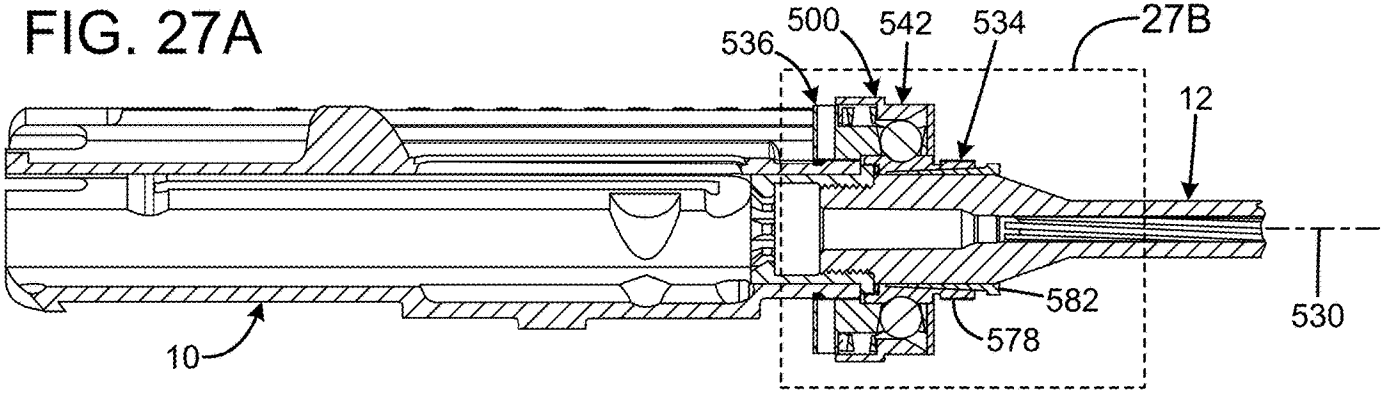
FIG. 27A is a side sectional view of the embodiment of a quick detach facility for a firearm of FIG. 24 attaching the barrel of FIG. 25 to the frame/upper receiver of FIG. 26.
Figure 27B:
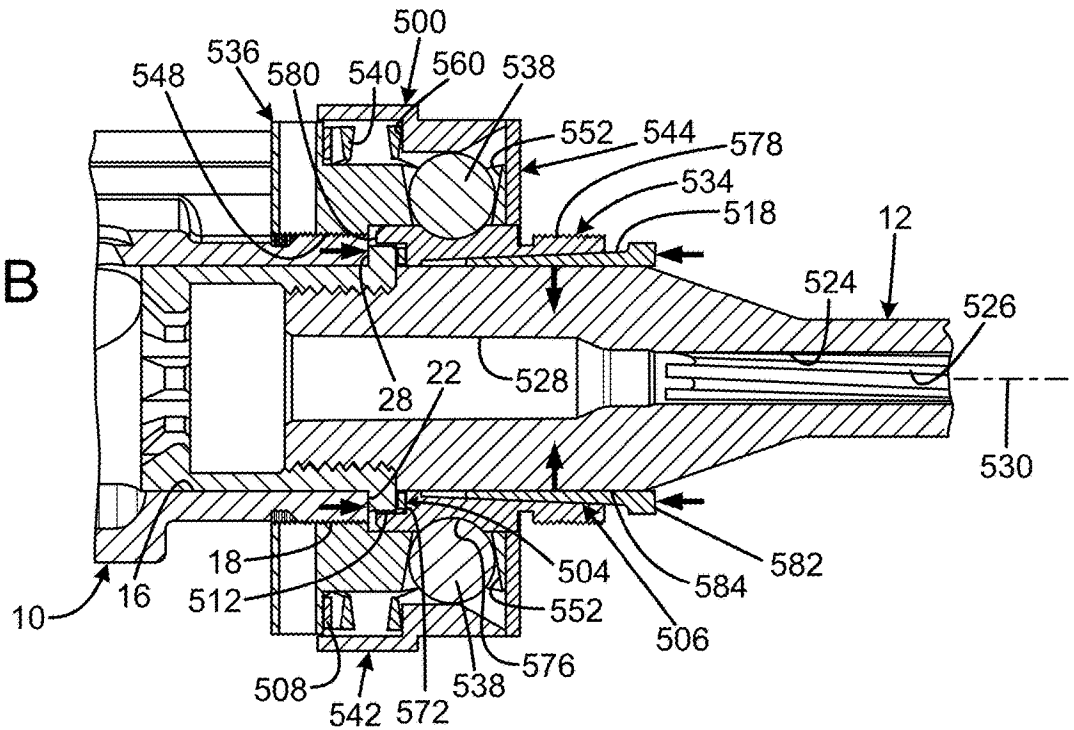
FIG. 27B is an enlargement of the rectangular area 27B of FIG. 27A.
Figure 28B:
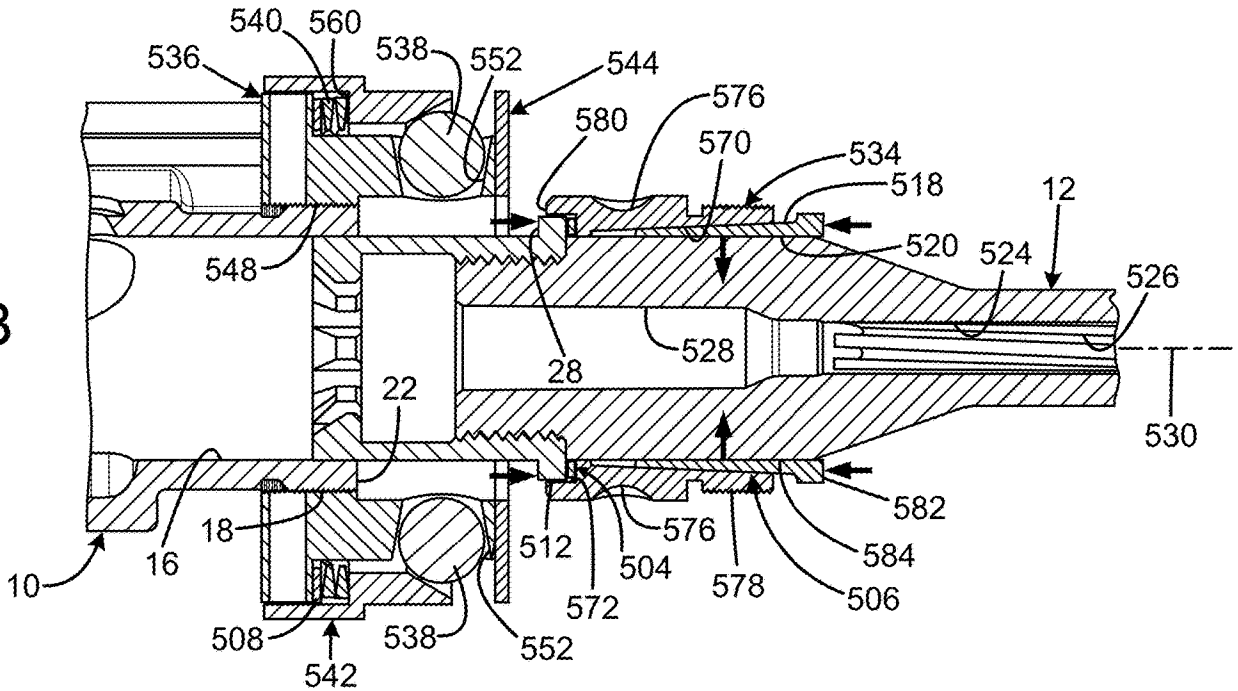
FIG. 28B is an enlargement of the rectangular area 28B of FIG. 28A.

Once inserted, the sliding lock collar 542 is released such that resilient element 540 forces the sliding lock collar 542 back to a locked position shown in FIGS. 27A & 27B, causing the locking elements 538 to engage the locking element receivers 576, securing the barrel 12 to the upper receiver 10 in the condition shown in FIGS. 27A & 27B.

The barrel 12 may be removed from the upper receiver 10 using the same procedure in reverse, resulting in the condition shown in FIGS. 28A & 28B where the barrel 12 is in the process of being disengaged and removed from the upper receiver 10.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

The foregoing description is by way of example only and does not limit in any way the scope of the present invention, which is set forth in the following claims. Additions, deletions, substitutions, and other modifications to the systems and methods described above may be made without departing from the scope or spirit of the present invention. For example, it should be appreciated that the current invention is adaptable to other firearm platforms in addition to the AR-15, AR Pistols, M4, M16 and similar prior art MILSPEC rifles previously described. The current invention is suitable for use with bolt action rifles, lever action rifles, revolvers, and self-loading pistols. The current invention can be used with any caliber range, along with any fixed barrel firing system in any configuration.

We claim:

1. A quick-detach barrel mounting facility for a firearm having a frame and a barrel comprising:

a first side element associated with a selected one of the frame and the barrel;

a second side element associated with the other one of the frame and the barrel;

a first side element including a first body defining a plurality of passages;

the first side element including a plurality of locking elements;

each locking element received in a passage and operable to reciprocate in the passage between an engaged position and a disengaged position;

the first side element including a latch element connected to the first body and having a locking surface proximate each of the passages and adapted to contact each of the locking elements;

the latch element being movable between an unlocked position in which the locking elements are enabled to move to the disengaged position and a locked position in which the locking elements are retained in the engaged position;

the second side element defining a plurality of apertures; and each aperture adapted for engagement by an associated locking element to secure the first side element to the second side element when the locking elements are in the engaged position, and to enable separation of the first side element from the second side element when the locking elements are in the disengaged position, such that the barrel is removable from the frame by moving the latch element to the unlocked position.

2. The quick-detach barrel mounting facility of claim 1 wherein the latch element is biased to the locked position.

3. The quick-detach barrel mounting facility of claim 1 wherein each locking element is a ball.

4. The quick-detach barrel mounting facility of claim 1 wherein each passage has a conical shape.

5. The quick-detach barrel mounting facility of claim 1 wherein each passage has a tapered shape.

6. The quick-detach barrel mounting facility of claim 1 wherein the barrel defines a barrel axis, and wherein each passage extends radially away from the barrel axis.

7. The quick-detach barrel mounting facility of claim 1 wherein each passage is adapted to closely fit the associated locking element when the locking element is in the engaged position.

8. The quick-detach barrel mounting facility of claim 1 wherein the latch element is a ring encompassing the first body.

9. The quick-detach barrel mounting facility of claim 8 wherein the ring has a tapered interior surface.

10. The quick-detach barrel mounting facility of claim 9 wherein the barrel defines a barrel axis and the tapered interior surface is angularly offset from the barrel axis.

11. The quick-detach barrel mounting facility of claim 1 wherein the plurality of apertures is configured to closely fit the locking elements.

12. The quick-detach barrel mounting facility of claim 1 wherein the barrel and frame are threaded for connection to each other, and wherein one of the first and second side element has a threaded feature adapted for connection to the frame and the other of the first and second side element has a threaded feature adapted for connection to the barrel, such that the first and second side element may be interposed between barrel and frame to convert the barrel and frame to a quick detach capability.

13. The quick-detach barrel mounting facility of claim 1 wherein one of the first and second side element is integrated with one of the frame and the barrel.

14. The quick-detach barrel mounting facility of claim 1 wherein one of the first and second side element is integrated with one of the frame and the other of the first and second side element is integrated with the barrel.

15. The quick-detach barrel mounting facility of claim 1 wherein the first body defines a cylindrical bore and a second body includes a cylindrical protrusion sized to be closely received in the cylindrical bore.

16. The quick-detach barrel mounting facility of claim 15 wherein the cylindrical protrusion has a peripheral cylindrical surface and wherein the plurality of apertures is defined in the peripheral cylindrical surface.

17. The quick-detach barrel mounting facility of claim 1 wherein the first body defines a plurality of gas tube apertures, each configured to receive a gas tube.

18. The quick-detach barrel mounting facility of claim 1 wherein the first body a second body are rotationally disengaged from each other except by the locking elements.

* * * * *